US009307797B2

(12) United States Patent
Sánchez Giráldez

(10) Patent No.: US 9,307,797 B2
(45) Date of Patent: Apr. 12, 2016

(54) MAGNETIC LOCK, MAGNETIC KEY AND COMBINATION THEREOF

(75) Inventor: José Humberto Sánchez Giráldez, Tostedt (DE)

(73) Assignee: Rosemarie Wysoczki de Sanchez, Jesteburg (DE)

( * ) Notice: Subject to any disclaimer, the term of this patent is extended or adjusted under 35 U.S.C. 154(b) by 74 days.

(21) Appl. No.: 13/319,040

(22) PCT Filed: Dec. 23, 2009

(86) PCT No.: PCT/IB2009/055921

§ 371 (c)(1), (2), (4) Date: Feb. 16, 2012

(87) PCT Pub. No.: WO2010/128367

PCT Pub. Date: Nov. 11, 2010

(65) Prior Publication Data

US 2012/0131967 A1 May 31, 2012

(30) Foreign Application Priority Data

May 7, 2009 (DE) ..... 20 2009 004 793 U

(51) Int. Cl.

| | |
|---|---|
| ***E05B 73/00*** | (2006.01) |
| ***A41F 1/00*** | (2006.01) |
| ***E05B 47/00*** | (2006.01) |
| ***E05B 67/36*** | (2006.01) |

(52) U.S. Cl.

CPC ..... *A41F 1/002* (2013.01); *E05B 47/0038* (2013.01); *E05B 47/0045* (2013.01); *E05B 67/36* (2013.01); *A44D 2203/00* (2013.01); *Y10T 70/7057* (2015.04); *Y10T 292/11* (2015.04)

(58) Field of Classification Search

USPC ..... 70/33, 34, 57.1, 276, 413; 24/704.1

See application file for complete search history.

(56) References Cited

U.S. PATENT DOCUMENTS

| | | | | |
|---|---|---|---|---|
| 3,638,285 | A * | 2/1972 | Sanchez Giraldez | 24/108 |
| 3,942,829 | A * | 3/1976 | Humble et al. | 70/57.1 |
| 4,299,870 | A * | 11/1981 | Humble | 70/57.1 |
| 4,425,771 | A | 1/1984 | Beach et al. | |
| 4,502,717 | A * | 3/1985 | Close | 70/57.1 |

(Continued)

FOREIGN PATENT DOCUMENTS

| | | |
|---|---|---|
| DE | 3209946 A1 | 9/1983 |
| EP | 1355550 | 10/2003 |

(Continued)

OTHER PUBLICATIONS

Definition of "permanent magnet" from Dictionary.com, Collins English Dictionary—Complete & Unabridged 10th Edition.*

(Continued)

*Primary Examiner* — Christopher Boswell

(74) *Attorney, Agent, or Firm* — Vidas Arrett & Steinkraus

(57) ABSTRACT

A magnetic lock (20) has at least one catch (36) having a lock plate (53). At least one first magnet (44) is arranged on the catch (36). The catch (36) can move back and forth between a locked position and unlocked position such that, when in unlocked position, the lock plate (53) at least partially closes a locating hole (26) for a shaft (22). Furthermore, a second magnet (48) is provided in the magnetic lock (20) that pulls the first magnet (44)—and the catch (36) along with it—into locked position.

13 Claims, 17 Drawing Sheets

(56) References Cited

U.S. PATENT DOCUMENTS

| | | | | |
|---|---|---|---|---|
| 4,651,136 | A * | 3/1987 | Anderson et al. | 70/57.1 |
| 4,685,234 | A * | 8/1987 | Anderson et al. | 340/572.9 |
| 4,774,503 | A * | 9/1988 | Bussard | 70/57.1 |
| 4,884,833 | A * | 12/1989 | Pedersen | 24/707 |
| 4,987,754 | A * | 1/1991 | Minasy et al. | 70/57.1 |
| 5,019,801 | A * | 5/1991 | Anderson, III | 340/572.3 |
| 5,077,872 | A * | 1/1992 | Guthammar | 70/57.1 |
| 5,600,977 | A * | 2/1997 | Piron | 70/57.1 |
| 6,023,951 | A * | 2/2000 | Maurer et al. | 70/57.1 |
| 6,182,336 | B1 | 2/2001 | Bauer | |
| 6,191,692 | B1 * | 2/2001 | Stoltz et al. | 340/572.1 |
| 7,575,389 | B2 * | 8/2009 | Nance | 403/109.2 |
| 8,156,628 | B2 * | 4/2012 | Roth | 29/426.1 |
| 2004/0159131 | A1 * | 8/2004 | Huehner | 70/57.1 |
| 2006/0070411 | A1 * | 4/2006 | Ho et al. | 70/57.1 |
| 2009/0205381 | A1 * | 8/2009 | Ho | 70/57.1 |

FOREIGN PATENT DOCUMENTS

| | | |
|---|---|---|
| JP | 38-14897 | 7/1963 |
| JP | H4-11103 A | 3/1992 |
| JP | H06-1651 | 1/1994 |
| JP | H07-5171 | 2/1995 |
| JP | H7-55776 A | 12/1995 |

OTHER PUBLICATIONS

English Translation of JP 38-14897.

* cited by examiner

MAGNETIC LOCK, MAGNETIC KEY AND COMBINATION THEREOF

CROSS-REFERENCE TO RELATED APPLICATIONS

This application is a national stage of PCT Application No. PCT/IB2009/055921 filed Dec. 23, 2009.

STATEMENT REGARDING FEDERALLY SPONSORED RESEARCH

Not applicable.

BACKGROUND OF THE INVENTION

The present application relates to a magnetic lock, a magnetic key, and a compatible combination of a magnetic lock and magnetic key as disclosed in EP1 355 550.

The present application provides a magnetic lock that has a comparatively simpler design and is easier to use.

The application relates to a magnetic lock having at least one latch which can be designed as a catch with a lock plate. The latch has a first magnet which can be moved back and forth between a locked position and unlocked position so that, when in the locked position, the latch completely or at least partially closes a receiving hole for a locking element designed in particular as a pin. In addition, a second magnet is in the magnetic lock, and the first magnet and second magnet exert force on each other. It is preferable to use permanent magnets; however, magnetizable materials can also be used as the magnet if the same effect is achieved with them. The latch is advantageously pulled into locked position under this force together with the magnet. This yields a space-saving and secure design of the magnetic lock. This involves both dynamic pulling as well as a static retention of the latch or respectively the catch.

Instead of mutually attracting magnets, they can be designed to repel each other. In many cases, this requires more space, however.

In another embodiment, a first latch and second latch—i.e. also a catch—that each have a lock plate are provided in the magnetic lock, and the first latch has at least one first magnet, and the second latch has the second magnet. The first latch and second latch can move back and forth between a locked position and unlocked position so that, when in locked position, the first latch and second latch, or respectively their lock plates, completely or at least partially close a receiving hole for the locking element or respectively the pin. This design is particularly secure and reliable to use because very little space is required to open and close the magnetic lock. When there are two latches or catches, they can be designed to move back and forth linearly between a locked position and unlocked position, whereas when the design only has a single latch or catch, it is frequently designed to rotate with an articulation. This rotatable arrangement needs to be designed so that the receiving hole for a locking element is cleared as much as possible when the lock is in the open position if reliable operation is to be guaranteed. In addition, the lock plates can engage the entire surface of the groove of a locking element or respectively pin.

The first catch and the second catch are advantageously pulled by the first magnet and second magnet into the locked position. Additional spring elements or rubber elements are also possible, however these are not absolutely necessary for a good lock. The first latch can also have two first magnets, whereas the second latch has two second magnets, and the first and second magnets exert force on each other in each case. This makes the magnetic lock more reliable to handle.

The locks or respectively catches can freely rotate in the magnetic lock, or they can also be secured against rotating relative to the magnetic lock by means of a lock contour, for example in the form of a bar in the magnetic lock, and by means of a latch contour as the catch contour, or as a contour in the catch, if the lock contour correspondingly engages in the latch contour.

In one embodiment, the application has a conical recess in a top part. There is a tip groove in the bottom part, the latches being accommodated in the tip groove when the latches for example are accommodated in the recess and move relative to the conical recess by means of an external force. This prevents the magnetic lock from being manipulated because the tip groove counteracts the opening of the latch.

The latch can have a catch made of a nonmagnetic material which ensures that only the magnets pull each other and not, for example, the catches. This increases the reliability of the magnetic lock and prevents it from being opened from the outside, for example with a strong magnet.

The latch can have a lock plate having metal. In conjunction with a catch, the catch then only needs to be made of a light material, whereas the lock plate closing the receiving hole is for example made of stable steel.

The application also comprises a lock arrangement having such a magnetic lock, and having a locking element or pin having a conically shaped pin head, a peripheral pin groove below the pin head, and a pin shaft below the peripheral pin groove. In the locked position, the latch or respectively latches engages or respectively engage the peripheral pin groove.

To open the lock, a magnetic key is provided with at least two key magnets that are arranged in a plane so that a north pole of a key magnet faces upward, and a north pole of another key magnet faces downward. This feature results from the requirement that the key magnets need to overcome the force acting between the lock magnets to pull the catch into the open position. In a more general form, the key magnets are arranged next to each other so that a north pole of a key magnet faces in one direction, and a north pole of another key magnet faces substantially in the opposite direction. Accordingly, other designs are also conceivable for which the terms "top" and "bottom" as well as "arranged in a plane" are not directly applicable.

Four key magnets can also be provided that are arranged around a center point in a plane so that the same pole of key magnets that oppose each other with reference to the center point always faces upwards. This is particularly safe because catches designed in this manner are difficult or impossible to open using an external key magnet that does not have a correspondingly complex pole arrangement. Only a magnetic key with a correct design will open these latches or respectively catches.

Alignment during opening is made easier by arranging the key magnets on a disk that can rotate around a rotary axis.

Protrusions or steps can be provided on a protrusion on the bottom side of the magnetic key that engage in recesses which are provided in the top side of the top part of the magnetic lock. This makes alignment easier when placing the magnetic key on a magnetic clock.

Finally, the application also comprises a combination of such a magnetic key and such a magnetic lock, each key magnet having a horizontal offset in relation to a neighboring lock magnet when in unlocked position so that the key magnets are further apart than the lock magnets, thereby enabling the lock to open reliably. The same advantage results when each key magnet in unlocked position is vertically offset in relation to a neighboring lock magnet.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated Details will be indicated in the following description of the figures to describe the embodiments of the invention. However, it should be obvious to a person skilled in the art that the embodiments can also be designed without these details.

FIG. 1 to FIG. 5 show a first embodiment of a magnetic lock and 20 in different views.

Figure 1:
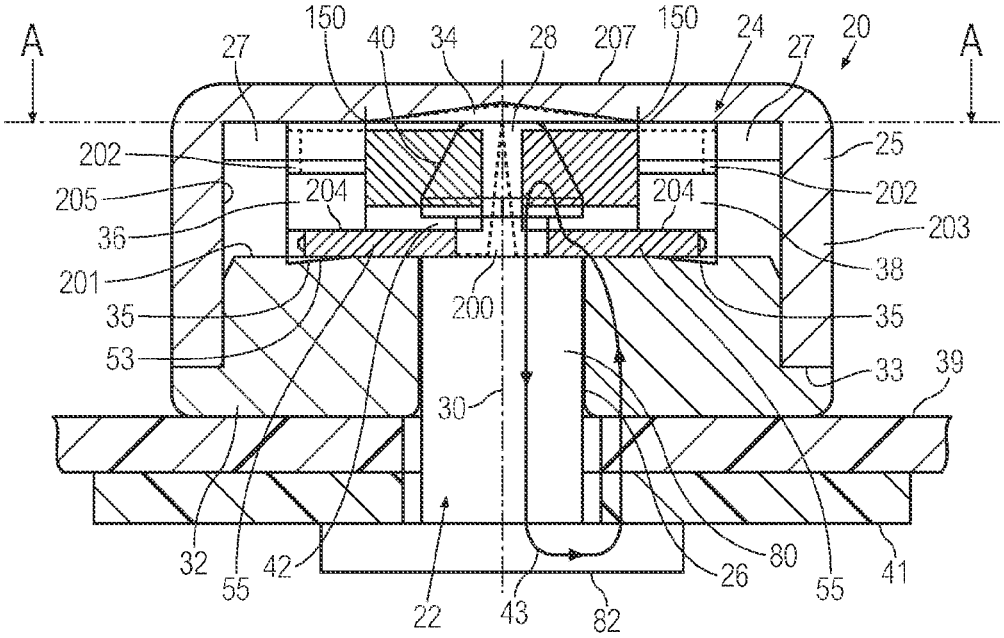
FIG. 1 shows a side view of a cross-section of a first embodiment of a magnetic lock according to the application in a locked position.

FIG. 1 shows a cross-section of the magnetic lock 20 in a locked position from the side. The magnetic lock 20 comprises a pin 22, a housing 24 and other components within the housing 24. The housing 24 has a circular opening 26 in the floor of the housing 24. A pin head 28 of the pin 22 is inserted into the opening 26 to lock the pin 22 in the housing 24. The pin 22 is easiest to see in FIG. 3 which completely displays the pin 22. From top to bottom, the pin 22 has the following: A pin head 28, a peripheral pin groove 42, a pin shaft 80 and a pin foot 82. The pin shaft 80 that is designed as a straight cylinder with an unchanging diameter connects the peripheral pin groove 42 to the pin foot 82. The pin foot 82 is designed in the form of a thin and large circular plate. The pin head 28, peripheral pin groove 42, pin shaft 80 and pin foot 82 are aligned axially with reference to their longitudinal axes so that their longitudinal axes also coincide with the longitudinal axis 30 of the housing 24. Between the pin foot 82 and bottom part 32, there is a bandage strap 39 with an eyelet 41 that is affixed to a bandage strap 39 for enforcement. The bandage strap 39 and eyelet 41 are clamped between the pin foot and bottom part 32. The eyelet 41 surrounds the pin shaft 80. This arrangement is used to retain an individual (not shown).

The housing 24 has a cylindrical top part 25 that is designed open in the direction of the floor of the housing 24. On the wall of the top part 25 located at the top, there is a conical or respectively tapered recess 34 or respectively seat that is particularly easy to see in FIG. 3 and FIG. 4. The housing 24 also has a bottom part 32 that seals the bottom end of the top part 25. The bottom part 32 and top part 25 form a cavity within that contains the other components of the magnetic lock 20. An opening 26 is in the middle of the bottom part 32 and extends through the bottom part 32. Both the opening 26 and pin 22 are aligned axially relative to the longitudinal axis 30 of the housing 24.

The bottom part 32 inserted in the top part 25 has the shape of a solid cylinder with a peripheral ledge 33. A tip groove 35 is cut into the top side of the bottom part 32 opposite the lock plates 53, 55. The tip groove 35 forms a circle with the longitudinal axis 30 as a midpoint and grows deeper from the inside toward the outside. The bottom part 32 is inserted in an opening of the top part 25 that is wide enough to seal the top part 25. Between the top wall of the top part 25 and the bottom part 32, a cavity is cut out. The height of the cavity is slightly greater than the height of the frusti-conical pin head 28 and the pin groove 42. The bottom part 32 is glued into the top part 25 so that the two parts 25, 32 of the housing 24 are tightly joined and aligned axially along the longitudinal axis 30 of the housing 24.

Figure 2:
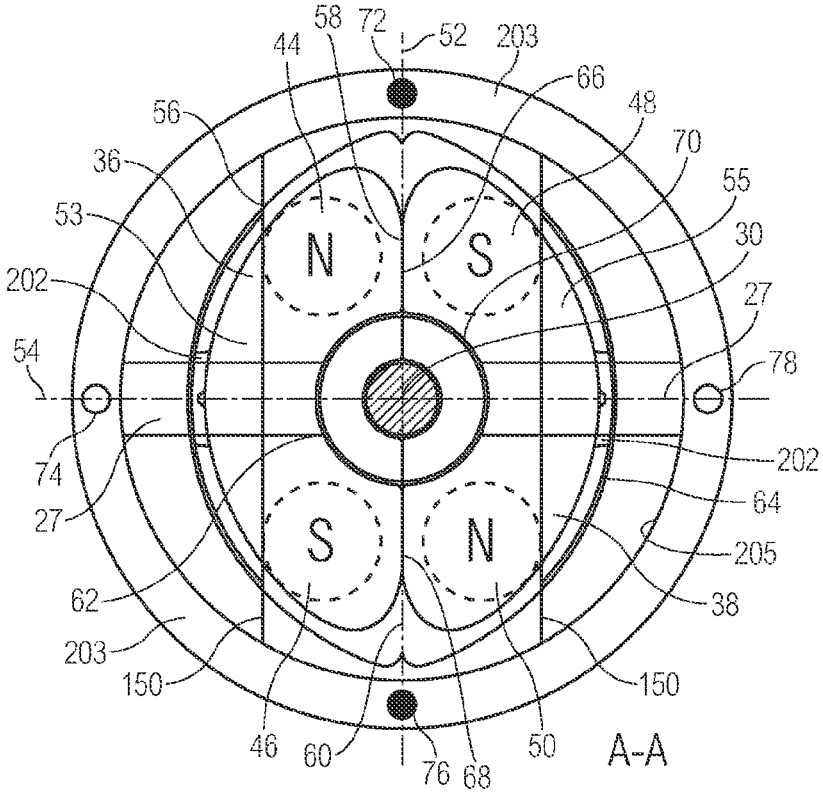
FIG. 2 shows a plan view of a cross-section of the magnetic lock according to FIG. 1.

Two magnetic catches 36, 38 are provided in the cavity between the top part 25 and bottom part 32. The two magnetic catches 36, 38 have an identical shape similar to a half moon. This shape of the magnetic catches is particularly easy to see in FIG. 2 which is a plan view of a cross-section of the magnetic lock 20 along the line of intersection A-A from FIG. 1. The two magnetic catches 36, 38 lie movably on an inner plane surface 201 of the bottom part 32. The front faces 58, 60, 66, 68 of the half-moon-shaped areas abut each other. In FIG. 2, the left magnetic catch 36 is placed on the left side of the bottom part 32, whereas the right magnetic catch 38 is placed on the right side of the bottom part 32. The left magnetic catch 36 and right magnetic catch 38 are accordingly arranged symmetrical to the longitudinal axis 30 of the housing 24. The magnetic catches 36, 38 are movable on the bottom part 32. The guide bar 27 in the top part 25 engages in a notch in the contour 202 in the magnetic catches 36, 38 and keeps the magnetic catches from rotating about the axis 30 of the magnetic lock 20. The guide bar 27 is particularly easy to see in FIGS. 18 to 20, and the notch in the contour 202 is particularly easy to see in FIG. 21.

The top ends of the two magnetic catches 36, 38 contact each other but leave a gap 200 at their bottom end. This gap 200 has the profile of an inverted V as can be seen in FIG. 1. Additional details of the magnetic catches 36, 38 are also particularly easier to see in FIG. 2. Each of the magnetic catches 36, 38 has two magnets and one lock plate. All four magnets are ferrite magnets or NdFeB magnets. The left magnetic catch 36 has two magnets 44, 46 above a left lock plate 53. The right magnetic catch 38 has two other magnets 48, 50 above a right lock plate 55.

The structure of the pin 22 with the pin head 28 that is designed as a conical frustum is particularly easy to see in FIG. 1. In comparison to the pin diameter of the pin 22, a front end of the pin 22 has a reduced diameter. Arranged below the pin head 28 is a peripheral pin groove 42 running around the pin 22. Parts of the two magnetic catches 36, 38 above the lock plates 53, 55 abut the peripheral pin groove 42 of the pin 22.

FIG. 2 shows a plan view of the magnetic lock 20 along intersecting line A-A in FIG. 1 so that the parts of the magnetic lock 20 can be identified. In the plan view, the housing 24 has a circular shaped outer profile. In the housing 24, a vertical axis 52 and horizontal axis 54 are drawn such that the two axes 52, 54 run at a right angle in relation to each other and intersect in the middle of the housing 24. The projection of the longitudinal axis 30 therefore coincides with the intersection of the horizontal axis 54 with the vertical axis 52. A cylindrical wall 203 of the housing 24 encloses both the magnetic catches 36, 38 as well as the pin head 28 of the pin 22. In the center of the housing 24, two concentric circles indicate the frusticonical pin head 28 of the pin 22. The two magnetic catches 36, 38 are arranged close to the pin 22 at the peripheral pin groove 42.

The left magnetic catch 36 has a left lock plate 53 and two round magnets 44, 46 on the top plane surface of the left lock plate 53, that is, a left, top lock magnet 44 and a left bottom lock magnet 46. The left top lock magnet 44 and the left bottom lock magnet 46 are arranged symmetrical to the horizontal axis 54 at opposite ends of the half-moon-shaped left lock plate 53 or respectively at opposite ends of the left magnetic catch 36. A north pole of the left, top lock magnet 44 and a south pole of the left bottom lock magnet 46 face upward.

At the left side of the magnetic catch 36, the left magnetic catch 36 has an outer edge 56 that is partially circular. The outer edge 56 mates with an inner wall 205 of the top part 25. Arranged on the right side of the left magnetic catch 36 are two short, The bottom part 32 inserted in the top part 25 has the shape of a solid cylinder with a peripheral ledge 33. A tip groove 35 is cut into the top side of the bottom part 32 opposite the lock plates 53, 55. The tip groove 35 forms a circle with the longitudinal axis 30 as a midpoint and grows deeper from the inside toward the outside. The bottom part 32 is inserted in an opening of the top part 25 that is wide enough to seal the top part 25. Between the top wall of the top part 25 and the bottom part 32, a cavity is cut out. The height of the cavity is slightly greater than the height of the frusti-conical pin head 28 and the pin groove 42. The bottom part 32 is glued into the top part 25 so that the two parts 25, 32 of the housing 2 are tightly joined and aligned axially along the longitudinal axis 30 of the housing 24.

Two magnetic catches 36, 38 are provided in the cavity between the top part 25 and bottom part 32. The two magnetic catches 36, 38 have an identical shape similar to a half moon. This shape of the magnetic catches is particularly easy to see in FIG. 2 which is a plan view of a cross-section of the magnetic lock 20 along the line of intersection A-A from FIG. 1. The two magnetic catches 36, 38 lie movably on an inner plane surface 201 of the bottom part 32. The front faces 58, 60, 66, 68 of the half-moon-shaped areas abut each other. In FIG. 2, the left magnetic catch 36 is placed on the left side of the bottom part 32, whereas the right magnetic catch 38 is placed on the right side of the bottom part 32. The left magnetic catch 36 and right magnetic catch 38 are accordingly arranged symmetrical to the longitudinal axis 30 of the housing 24. The magnetic catches 36, 38 are movable on the bottom part 32. The guide bar 27 in the top part 25 engages in a notch in the contour 202 in the magnetic catches 36, 38 and keeps the magnetic catches from rotating about the axis 30 of the magnetic lock 20. The guide bar 27 is particularly easy to see in FIGS. 18 to 20, and the notch in the contour 202 is particularly easy to see in FIG. 21.

The top ends of the two magnetic catches 36, 38 contact each other but leave a gap 200 at their bottom end. This gap 200 has the profile of an inverted V as can be seen in FIG. 1. Additional details of the magnetic catches 36, 38 are also particularly easier to see in FIG. 2. Each of the magnetic catches 36, 38 has two magnets and one lock plate. All four magnets are ferrite magnets or NdFeB magnets. The left magnetic catch 36 has two magnets 44, 46 above a left lock plate 53. The right magnetic catch 38 has two other magnets 48, 50 above a right lock plate 55.

The structure of the pin 22 with the pin head 28 that is designed as a conical frustum is particularly easy to see in FIG. 1. In comparison to the pin diameter of the pin 22, a front end of the pin 22 has a reduced diameter. Arranged below the pin head 28 is a peripheral pin groove 42 running around the pin 22. Parts of the two magnetic catches 36, 38 above the lock plates 53, 55 abut the peripheral pin groove 42 of the pin 22.

FIG. 2 shows a plan view of the magnetic lock 20 along intersecting line A-A in FIG. 1 so that the parts of the magnetic lock 20 can be identified. In the plan view, the housing 24 has a circular shaped outer profile. In the housing 24, a vertical axis 52 and horizontal axis 54 are drawn such that the two axes 52, 54 run at a right angle in relation to each other and intersect in the middle of the housing 24. The projection of the longitudinal axis 30 therefore coincides with the intersection of the horizontal axis 54 with the vertical axis 52. A cylindrical wall 203 of the housing 24 encloses both the magnetic catches 36, 38 as well as the pin head 28 of the pin 22. In the center of the housing 24, two concentric circles indicate the frusticonical pin head 28 of the pin 22. The two magnetic catches 36, 38 are arranged close to the pin 22 at the peripheral pin groove 42.

The left magnetic catch 36 has a left lock plate 53 and two round magnets 44, 46 on the top plane surface of the left lock plate 53, that is, a left, top lock magnet 44 and a left bottom lock magnet 46. The left top lock magnet 44 and the left bottom lock magnet 46 are arranged symmetrical to the horizontal axis 54 at opposite ends of the half-moon-shaped left lock plate 52 or respectively at opposite ends of the left magnetic catch 36. A north pole of the left, top lock magnet 44 and a south pole of the left bottom lock magnet 46 face upward.

At the left side of the magnetic catch 36, the left magnetic catch 36 has an outer edge 56 that is partially circular. The outer edge 56 mates with an inner wall 205 of the top part 25. Arranged on the right side of the left magnetic catch 36 are two short, left straight edges 58, 60 of the same length. In the middle part of the left magnetic catch 36, a left, semicircular edge 62 is formed on the right that connects the two left, straight edges 58, 60 with each other. The two short, left straight edges 58, 60 are formed by a top, left straight edge 58 on the top end and a bottom, left straight edge 60 on the bottom end. The two left, straight edges 58, 60 are arranged symmetrical to the horizontal axis 54.

The right magnetic catch 38 is constructed identical to the left magnetic catch 36. The right magnetic catch 38 has a right lock plate 55 and two round magnets 48, 50 at the top and bottom end of the right stable plate 54, that is, a right, top lock magnet 48 and a right, bottom lock magnet 50. The round magnets 48, 50 are arranged symmetrical to the horizontal axis 54 at opposite ends of the half-moon-shaped, right magnetic catch 38. A south pole of the right, top lock magnet 48 and a north pole of the right, bottom lock magnet 50 face upward.

At the right side of the magnetic catch 38, the right magnetic catch 38 has an outer edge 64 that is partially circular. The outer edge 64 mates with an inner wall 205 of the housing 24. Arranged on the left side of the right magnetic catch 38 are two short, right straight edges 50, 68 of the same length. In the middle part of the right magnetic catch 38, a right, semicircular edge 70 is formed on the left that connects the two short, right, straight edges 66, 68 with each other. The two short, right straight edges 66, 68 are formed by a top, right straight edge 66 on the top end and a bottom, right straight edge 68 on the bottom end. The two right, straight edges 66, 68 are arranged symmetrical to the horizontal axis 54.

As shown in FIG. 2, the top, left straight edge 58 contacts the top, right straight edge 66 in locked position, and the bottom, left straight edge 60 contacts the bottom, right straight edge 68 along the vertical axis 52. Furthermore, the left semicircular edge 62 and the right semicircular edge 70 are very close to the pin head 28 when the magnetic lock 20 according to FIG. 2 is in locked position. The cylindrical hole that is formed between the left and right magnetic catches 36, 38 has a somewhat larger diameter than the pin head 28.

A revolving arrow 43 indicates a flow of force 43 that can arise when force is exerted upward on the bandage strap 39 on the right side. The bottom part 32 is pushed upward to close the gap between the right lock plate 55 and the pin head 28. The flow of force 43 then runs from the bandage strap 39 via the bottom part 32, the right lock plate 55, the pin head 28, the pin shaft 80, the pin foot 82 and the eyelet 41. The top part 25 and magnetic catches 36, 38 are not within the flow of force.

To make it easier to position a magnetic key, additional markings on the outer, top end of the housing 24 can be optionally provided as shown in FIG. 2 according to another embodiment. The four markings 72, 74, 76, 78 are a top marking 72, a left marking 74, a bottom marking 76 and a right marking 78. The top marking 72 and bottom marking 76 are filled with paint, and they are arranged along the vertical axis 52. The paint has been omitted from the left marking 74 and right marking 78, and they are arranged along the horizontal axis 54. All four markings 72, 74, 76, 78 are arranged close to the outer edge of the housing 24.

Figure 3:
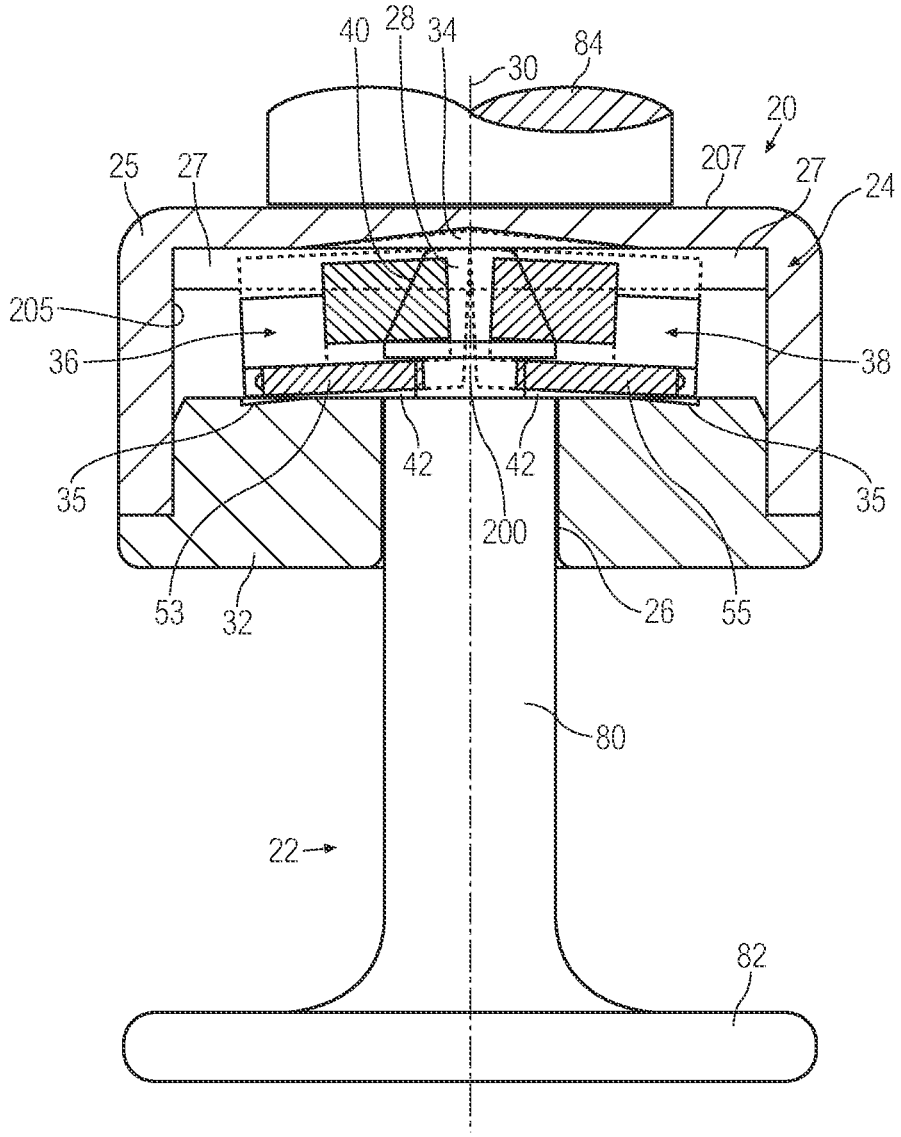
FIG. 3 shows a cross-section of the magnetic lock from FIG. 1 and FIG. 2 when any magnet is applied.

FIG. 3 shows a side view of the magnetic lock 20. In FIG. 3, the magnetic lock 20 is shown in an upright position, the housing 24 being placed on the top end of the pin 22. The left and right magnetic catches 36, 38 engage via the lock plates 53, 55 in the peripheral pin groove 42 of the pin 22 and prevent the magnetic lock 20 from being removed from the pin 22.

A strong magnet 84 is placed on the top plane surface 207 of the housing 24. The magnets 44, 46, 48, 50 of the magnetic catches 36, 38 are pulled to the magnet 84 when the magnet 84 is sufficiently strong. The two magnetic catches 36, 38 are thereby lifted and pressed against the conical recess 34. Their bordering edges 150 are particularly easy to see in FIG. 1 and FIG. 2. The bottom ends of the magnetic catches 36, 38 approach each other under the influence of any desired magnet 84. The V-shaped gap 200 between the magnetic catches 36, 38 shown in FIG. 1 thereby closes. The bottom sides of the lock plates 53, 55 and the bottom outer edge of the magnetic catches 36, 38 are pressed into the tip groove 35. Unlocking by any magnet is thereby prevented even when the magnetic catches are shifted in this state by moving the magnet 84 back and forth. The outer edge of the tip groove 35 namely mechanically blocks the magnetic catches 36, 38 and the lock plates 53, 55 against separating further from each other. The lock plates and 53, 55 in the peripheral pin groove 42 remaining enclosed between the pin shaft 80 and the frusti-conical pin head 28 so that the pin 22 cannot be pulled out of the opening 26.

Figure 4:
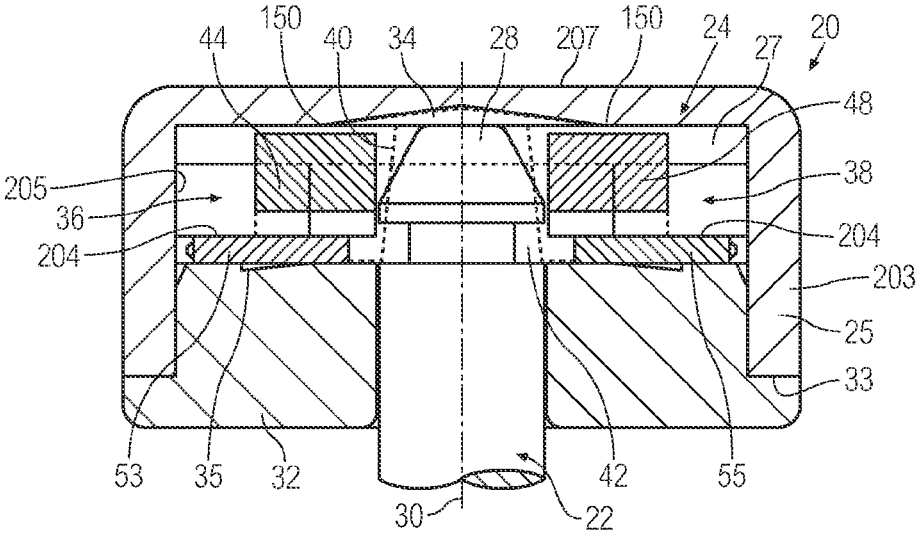
FIG. 4 shows a cross-section of the magnetic lock of the previous figure in an unlocked position.
Figure 5:
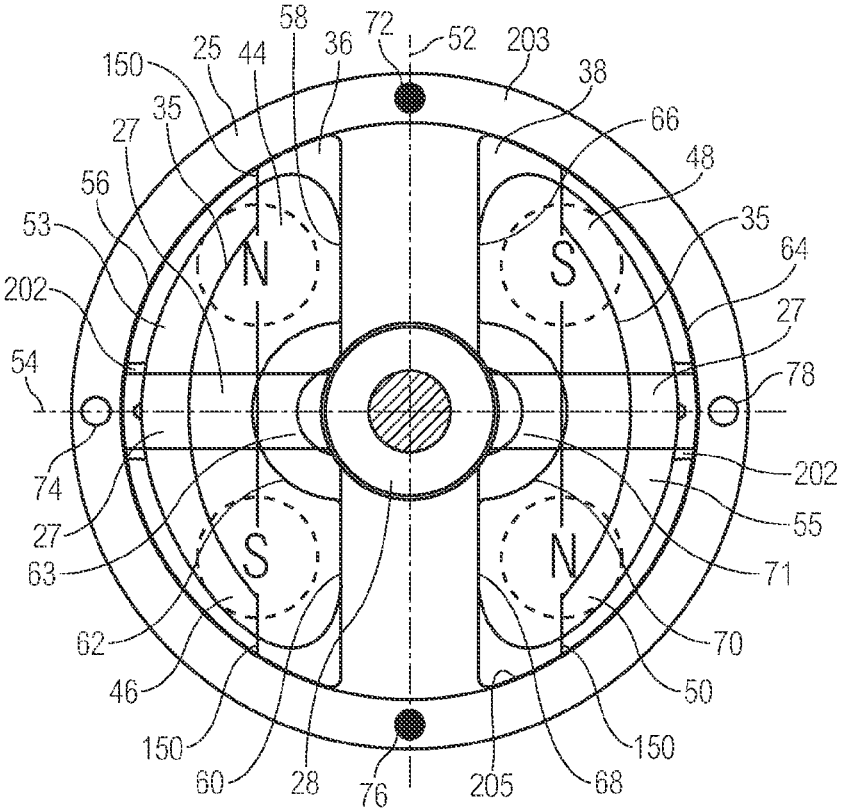
FIG. 5 shows a plan view of the magnetic lock from FIG. 4.

FIG. 4 and FIG. 5 show the magnetic lock 20 in an unlocked position. In comparison to FIGS. 1 to 3, the two magnetic catches 36, 38 are spaced further apart because the magnetic force of a magnetic key 90 (not shown) pulls the magnetic catches 36, 38 apart from each other until they lie on the inner wall 205 of the housing 24. This is easy to see in FIG. 8 which also shows the magnetic key 90. As shown in FIGS. 4 and 5, the left, inner semicircular edge 63 and the right, inner semicircular edge 71 of the lock plates 53, 55 are pulled out of the peripheral pin groove 42 so that the pin 22 can be pulled out of the opening 26 in the housing 24.

Figure 6:
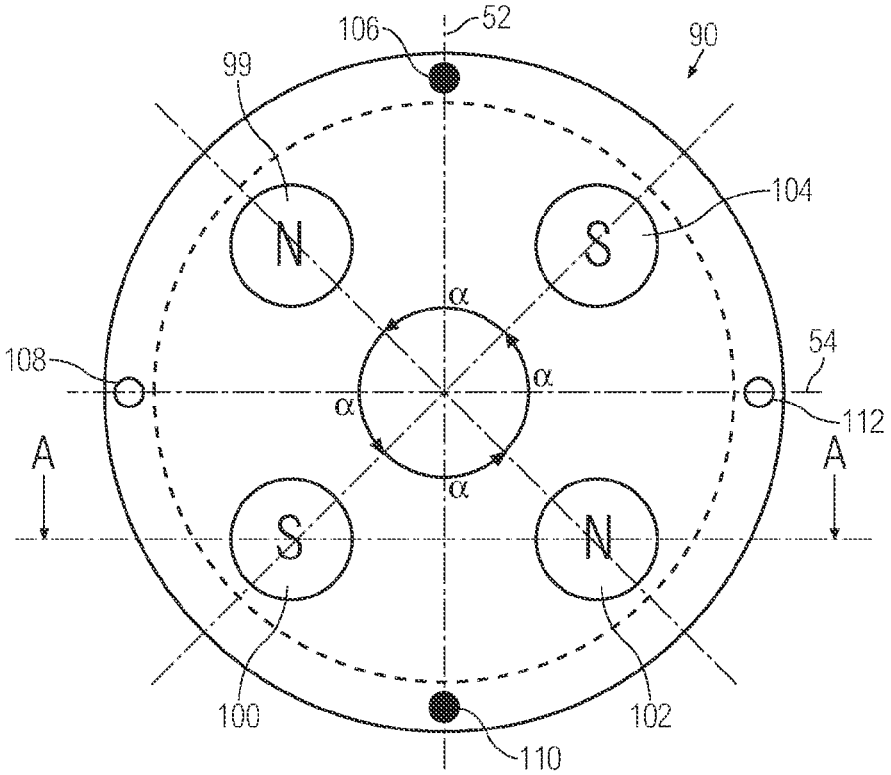
FIG. 6 shows a plan view of the magnetic key for the magnetic lock.
Figure 7:
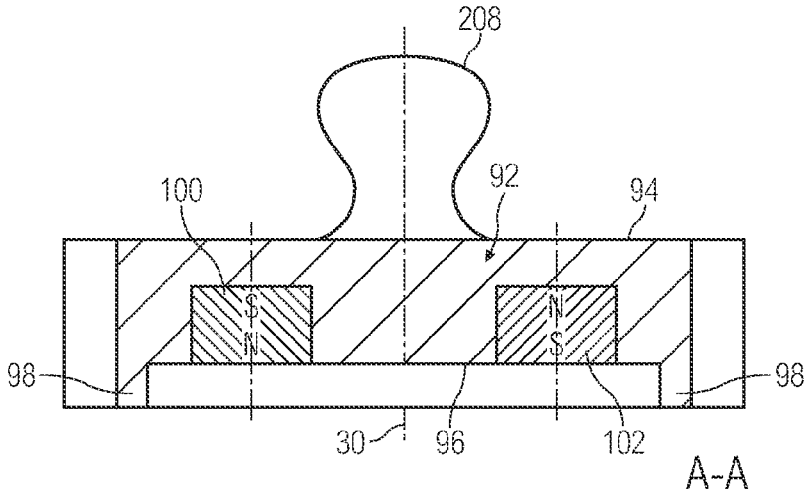
FIG. 7 shows a cross-section of the magnetic key corresponding to FIG. 6.

FIG. 6 and FIG. 7 show a first embodiment of the magnetic key 90 that is placed on the magnetic lock 20 according to FIGS. 4 and 5. FIG. 6 shows a plan view of the bottom floor surface of the magnetic key 90 for the magnetic lock 20. The magnetic key 90 has a substantially cylindrical body 92. The magnetic key 90 also has a cover 94 with a contour 208 for gripping manually and a flat floor surface 96. An annular edge 98 on the floor surface 96 faces downward. The inner diameter of the annular wall 98 is slightly larger than the outer diameter of the housing 24. The vertical axis 52 and the horizontal axis 54 intersect in the middle of the flat cover surface 94 so that the flat floor surface 96 is divided into four equal areas symmetrical to axes 52, 54.

Figure 8:
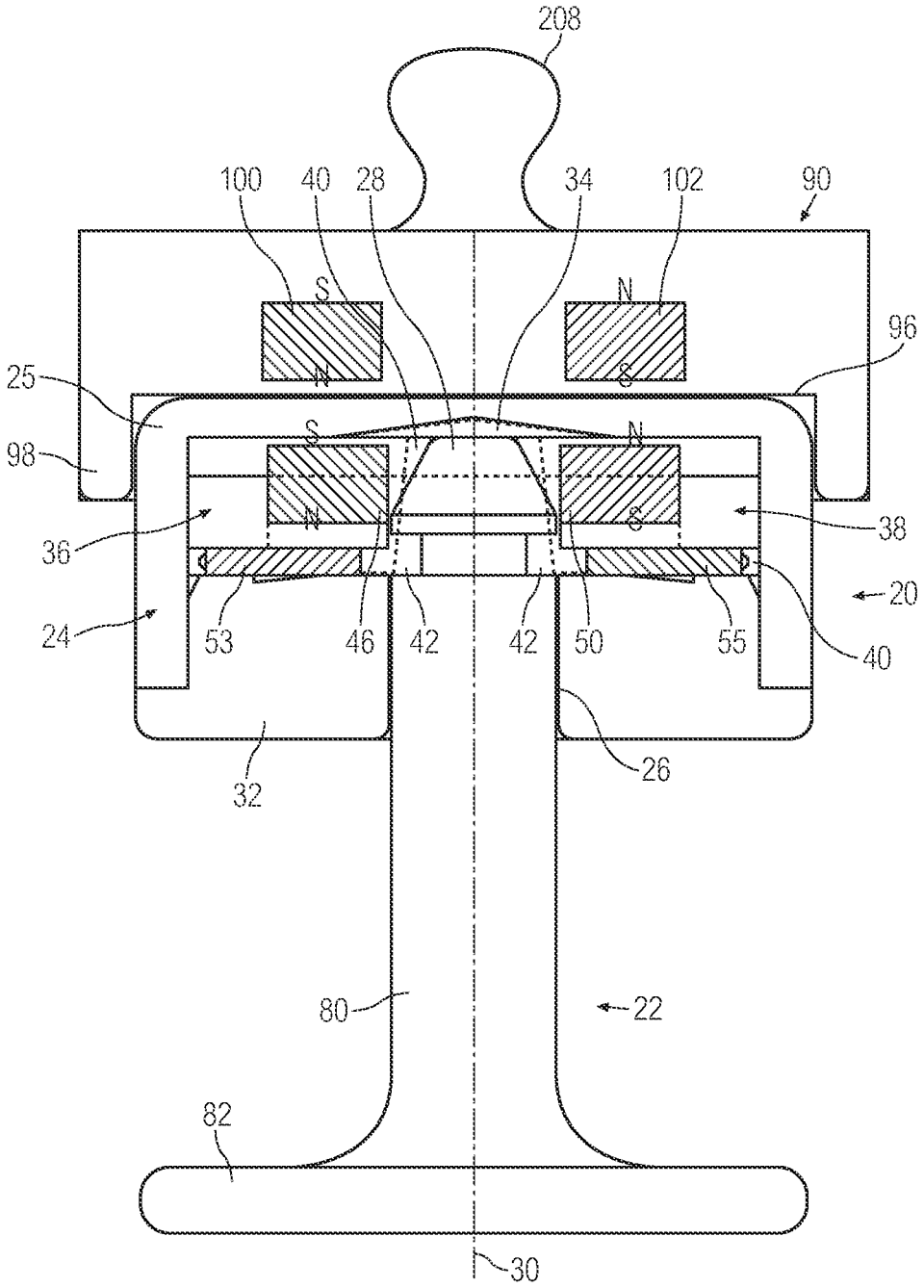
FIG. 8 shows a cross-section of the magnetic lock and magnetic key, as well as a pin in the unlocked position according to the previous figure.

Four round magnets 99, 100, 102, 104 are arranged equidistant in a ring about the longitudinal axis of the magnetic key 90. The longitudinal axis of the magnetic key 90 corresponds with the longitudinal axis 30 of the housing 24. All four rounds magnets 99, 100, 102, 104 are rare earth magnets or also NdFeB magnets, or also hard ferrite magnets. The four round magnets 99, 100, 102, 104 are fixed within the magnetic key 90. The orientation and arrangement of these round magnets 99, 100, 102, 104 are shown in FIGS. 6 to 8. The sets of two magnets neighboring each other in the shape of a ring have an intermediate angle $\alpha$ of 90°.

As shown in FIG. 6, the two top round magnets 99, 104 are arranged symmetrical to the two bottom round magnets 100, 102 with reference to the horizontal axis 54. The two left round magnets 99, 100 are arranged symmetrical to the right round magnets 102, 104 with reference to the vertical axis 52. The four round magnets 99, 100, 102, 104 are aligned so that the two diagonally opposing round magnets have the same upward-facing polarity. In the arrangement in FIG. 6, the south poles of the left, bottom key magnet 100 and the right, top key magnet 104 face upward, and the north poles of the right, bottom key magnet 102 and left, top key magnet 99 face upward.

Orientation markings 106, 108, 110, 112 of the magnetic key 90 are still distributed between the magnets neighboring each other in the shape of a ring. The four orientation markings 106, 108, 110, 112 are distributed evenly between the four round magnets 99, 100, 102, 104. In particular, the markings 99, 100, 102, 104 along the horizontal axis 54 or respectively the vertical axis 52 are distributed close to the outer edge of the magnetic key 90. The four rounds magnets 99, 100, 102, 104 are concealed within the magnetic key 90.

In the cross-sectional view in FIG. 7, the two round magnets 100, 102 arranged on the floor surface 96 of the magnetic key 90 are visible from the side. Furthermore, a contour 208 for gripping the magnetic key 90 manually is also shown.

FIG. 8 shows a side view of the magnetic lock 20 corresponding to FIGS. 4 to 5 in unlocked position together with the magnetic key 90 from FIG. 7 in a cross-sectional view.

The magnetic lock 20 is placed directly below the magnetic key 90 so that is accommodated in the edge 98. The markings 106, 108, 110, 112 on the magnetic key 90 are provided for the sake of illustration to match the markings 72, 74, 76, 78 on the magnetic lock 20. Only the two bottom round magnets 46, 50 of the magnetic lock are visible in FIG. 8. Furthermore, FIG. 8 illustrates that the round magnets 100, 102 of the magnetic lock 90, when in unlocked position, are further apart from each other than the round magnets 46, 50 of the magnetic lock 20. This ensures that the magnetic catches 36 are always reliably pulled into the open position. Due to the opposing polarity of the opposite sides of magnets 100, 46 and magnets 102, 50, attractive forces act between magnets 100, 46 and magnets 102, 50. The magnetic catches 36, 38 arranged to be freely movable are thereby pulled apart. The magnetic catches 36, 38 thereby move away from the pin 22 so that the locking plates 53, 55 of the magnetic catches 36, 38 also move away from each other and are pulled out of the peripheral pin groove 42 in the pin 22. When the locking plates 53, 55 are moved out of the peripheral pin groove 42, the pin 22 can be pulled out of the opening 26 in the housing 24.

The magnetic lock 20 creates a simple locking device for coupling and decoupling the pin 22 to and from the housing 24 and the bottom part 32. The magnetic lock 20 has very few components. Consequently, the magnetic lock 20 and magnetic key 90 can be easily designed and manufactured.

The requirements for the outer shape and inner coupling of the magnetic lock 20 typically lie within the tolerance range of the hundredth of a millimeter. These tolerances can be met with economical injection molded parts. The cost for mass producing the magnetic lock in large numbers can therefore be kept down.

The magnetic lock 20 does not need any expensive components. For example, the round magnets 44, 46, 48, 50 in the magnetic lock 20 can be designed as rare earth ferrite magnets. The round magnets 44, 46, 48, 50 in the housing 24 of the magnetic lock can also be ferrite or alnico magnets, which are also economical. The top part 25, bottom part 32, magnetic catches 36, 38 and the pin 22 can be economically manufactured by normal injection molding of thermoplastic materials such as polystyrene, ABS or respectively acrylonitrile-butadiene-styrene, polyamide, polypropylene, polyethylene and polyvinyl chloride or PVC. The pin can also be manufactured from steel or other metals.

The magnets of the magnetic lock 20 and magnetic key 90 can also have metal magnetic elements, composite and rare earth magnets. Suitable composite magnets for the magnet are for example ceramic magnets, ferrite magnets, alnico magnets, ticonal magnets, neodyme-iron-boron magnets, artificial resin-based injection molded magnets, flexible artificial resin or binder-based magnets, etc. Individual components of the magnetic lock 20 and magnetic key 90 can also be produced magnetized or consisting of permanent magnets corresponding to a predetermined magnetic pattern to achieve desired functions.

The magnetic lock 20 is robust and reliable. It is improbable that vibrations or improper handling will destroy the magnetic lock 20. These features allow the magnetic lock 20 to be used in a wide range of applications, for example to secure bandage systems, as a builder's lock or safety label for items of clothing and saddlebags.

The magnetic lock 20 can be easily integrated in other applications. For example, the housing 24 of the magnetic lock 20 can be an integral part of a door with child lock. The pin 22 of the magnetic lock 20 can be mounted on a door frame. A device with the magnetic lock 20 can be produced with an integrated locking function using the magnetic lock 20.

The markings 72, 74, 76, 78, 106, 108, 110, 112 on the housing 24 and magnetic key 90 make unlocking easy. The markings 72, 74, 76, 78, 106, 108, 110, 112 guide the user when using the magnetic lock 20. The markings 72, 74, 76, 78, 106, 108, 110, 112 can also be used as part of the decoration of the magnetic lock 20 and magnetic key 90.

The magnetic lock 20 does not need an external energy supply to use. For example, the magnetic lock 20 does not need a battery to use which can cost extra and cause a failure when the electricity is drained. The magnetic lock 20 is a closed system that can be used independently.

Alternately, the housing 24 can have a different shape such as a cube. When the housing 24 has a rectangular cover surface, a magnetic key that fits the cover surface can easily unlock the magnetic lock 20. The shape of the magnetic lock 20 makes it easy to correctly position the magnetic key 90 on the magnetic lock 20. Additional shapes where the magnetic key 90 has a shape that mates with the magnetic lock 20 are also possible.

According to one alternative, the peripheral pin groove 42 can assume a different shape that fits the magnetic catches 36, 38. Instead of two magnetic catches 36, 38, an individual magnetic catch can be provided, for example when the opening 26 is provided close to the side wall of the housing 24.

The pin 22 can also be produced in a different shape that can be blocked by the magnetic catches 36, 38. For example, the pin 22 can have a rectangular cross-section, a triangular cross-section, a polygon or a different shape. The opening 26 can also accommodate the pin with play.

The housing 24 of the magnetic lock 20 protects the magnetic catches 36, 38 from external vibration, corrosion, radiation, etc. Even if the housing 24 of the magnetic lock 20 were to drop a long distance, the internal magnetic catches 36, 38 would be protected against breaking and being scratched.

The round magnets 44, 46, 48, 50 of the magnetic lock 20 provide the motive force to open and close the magnetic lock 20. If there is no external magnet, the round magnet 44, 46, 48, 50 pulls the magnetic catches 36, 38 so that they move toward each other until they reach the locked position shown in FIG. 2 and fix the pin 22.

The round magnets 44, 46, 48, 50 within the housing 24 of the magnetic lock 20 are weaker magnets than the round magnets of the magnetic key 90. In the presence of the magnetic key 90 as shown in FIG. 8, the round magnets 44, 46, 48, 50 within the housing 24 are pulled toward the magnets 99, 100, 102, 104 of the magnetic key 90 so that the magnetic catches 36, 38 are moved away from each other and pulled into the unlocked position. The magnetic catches 36, 38 are thereby moved toward the cylindrical inner wall 205 of the housing 24.

The frusticonical pin head 28 of the pin 22 makes it easier to introduce the pin 22 into the housing 24 of the magnetic lock 20. Since the tip of the pin 22 has a smaller diameter than the opening 26 and the hole between the contacting catches 36, 38, the pin 22 can be easily pushed through the opening 26 and through this hole.

The peripheral pin groove 42 of the pin 22 interacts with the locking plates 53, 55 of the magnetic catches 36, 38 such that the locking plates 53, 55 restrain the pin 22 from moving out of the house 24 when the two locking plates 53, 55 are inserted in the peripheral pin groove 42.

A method for producing the magnetic lock involves the following steps: The sequence of some of the steps can be changed. In a first step, the housing 24 is provided. In a second step, the magnetic catches 36, 38 are brought with the magnets 44, 46, 48, 50 and the locking plates 53, 55 into the housing 24. In a third step, the magnetic catches 36, 38 in the housing 24 are covered with the bottom part 32. In a third step, the pin 22 can be provided. Optionally, the magnetic lock 20, the pin 22, or both can be fastened to an object to be closed. The method for producing the magnetic lock is simple to perform since a precise procedure can be achieved without machines.

On method for locking the magnetic lock 20 involves introducing the pin 22 into the opening 26. One method for unlocking the magnetic lock 20 involves bringing the magnetic key 90 into contact with the magnetic lock 20 according to a predetermined arrangement so that the pin 22 can be removed from the magnetic lock 20. The methods for locking and unlocking are easy to perform since no external energy and complex equipment are required.

The magnetic lock 90 can have a rotary disk with the aforementioned round magnets 99, 100, 102, 104 that, upon approaching the magnetic lock, independently align under the axial magnetic force with the polarization of the round magnets 44, 46, 48, 50 of the magnetic lock 20. Likewise, another embodiment can have a top part 25 without a guide bar 27 so that the polarization of the round magnets 44, 46, 48, 50 of the magnetic catches 36, 38 can align while freely rotating with that of the approaching magnetic key 90 having the round magnets 99, 100, 102,104.

It is also possible for a guide bar to be located on the bottom part 25 or on the magnetic catches 36, 38 to guide the magnetic catches 36, 38 and engage in an opposing contour.

FIGS. 9 to 17 show a magnetic lock 20 according to another embodiment. Numerous parts of the magnetic lock 20 from FIG. 9 correspond to the magnetic lock in the previous figures. Corresponding parts are provided with an apostrophe. The catches are left out in these views.

Figure 9:
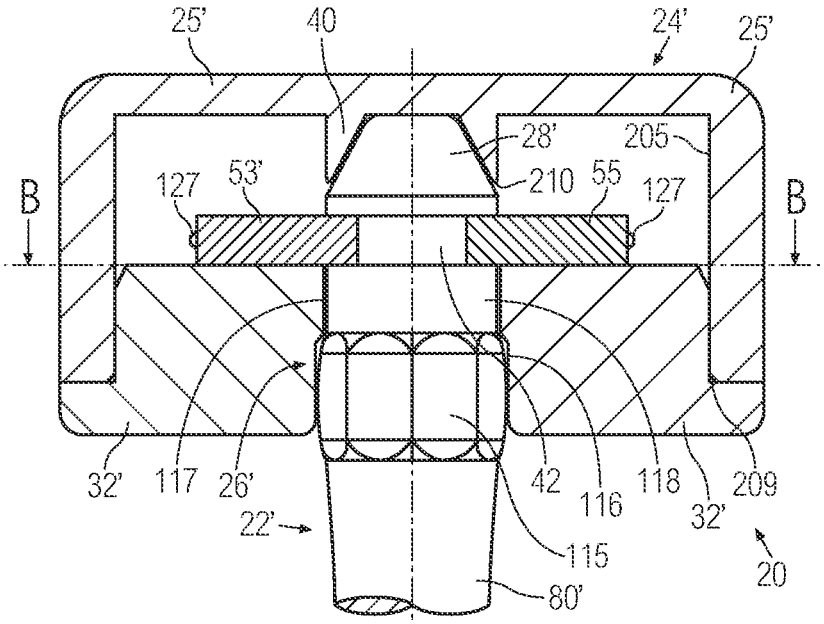
FIG. 9 shows a cross-section of a magnetic lock according to another embodiment.
Figure 16:
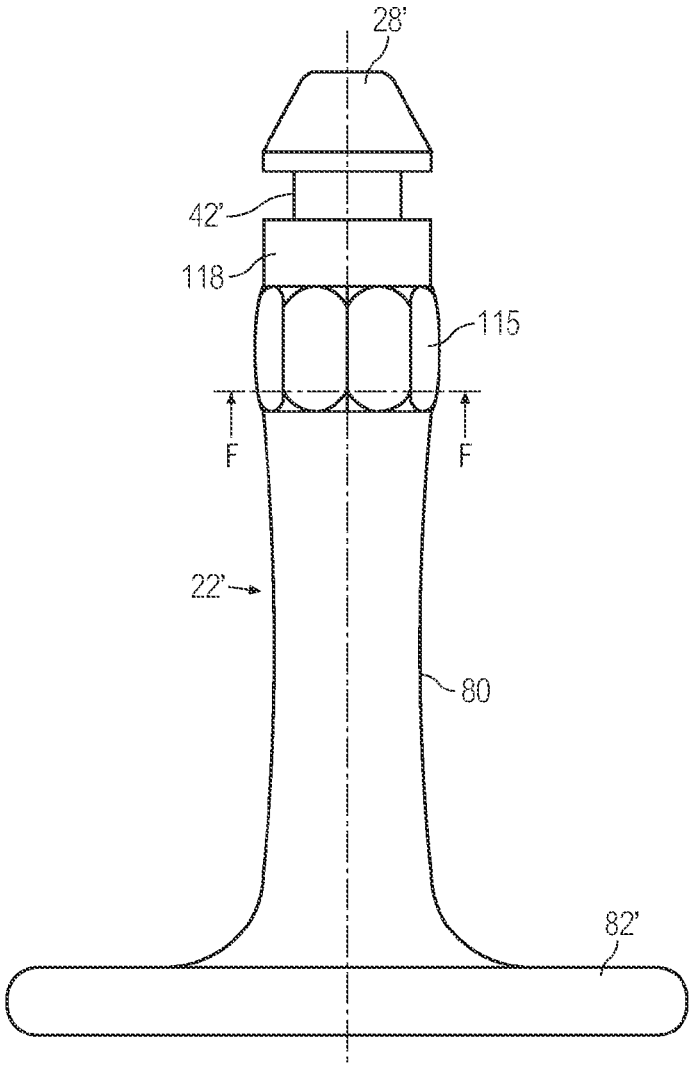
FIG. 16 shows a side view of a pin of the magnetic lock according to FIG. 9.

The pin shaft 80' from FIG. 9 is shown completely in FIG. 16. Below the pin groove 42', the pin shaft 80' has a cylindrical section 118 with a diameter corresponding to the diameter of the pin head 28'. Below the cylindrical section 118, the pin shaft 80' has a decagonal section 115 with a diameter that is somewhat larger than the diameter of the cylindrical section, and below the decagonal section 115, the pin shaft 80' has a bottom cylindrical section. A floor plate 82 adjoins the bottom cylindrical section. The bottom cylindrical section has a variable radius. The additional structure of the pin 22' corresponds to the structure of the pin from FIG. 8.

The bottom part 32' of the housing 24' shown in FIG. 8 has an opening 26' for introducing the pin 22'. The opening 26' has a cylindrical section 117 and, below the cylindrical section 117, a decagonal section 116. The cylindrical section 118 of the pin shaft 80' fits in the cylindrical section 117 of the opening 26'. Likewise, the decagonal section 115 of the pin shaft 80' fits in the decagonal section 116 of the opening 26'. The form closure of the decagonal section 115 with the decagonal recess 116 prevents the bottom part 32' from rotating relative to the pin shaft 80 so that the catches 36, 38 cannot be made to rotate relative to the pin shaft 80' by a quick rotation of the bottom part 32' or the top part 25' connected thereto and pulled apart by centrifugal force.

In contrast to the embodiment in FIG. 1, the top part 25' does not have a guide bar and a roof-shaped recess. Furthermore, the bottom part 32' does not have a tip groove.

Figure 10:
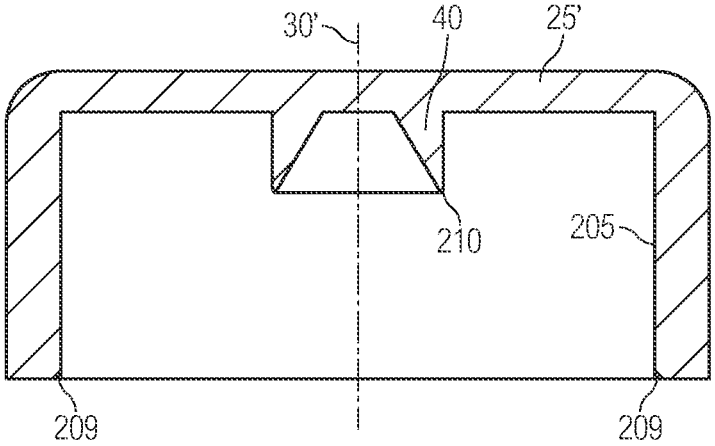
FIG. 10 shows a cross-section of the top part of the magnetic lock from FIG. 9.

FIG. 10 shows a cross-section of the top part 25' from FIG. 9. FIG. 10 shows a guide collar 40 that fits the pin head 28' in such a manner that it is accommodated positively as shown in FIG. 9. Furthermore, there is a radius 210 at the bottom side of the guide collar 40'. A peripheral chamfer is created on the bottom wall 205 of the top part 25'.

Figure 11:
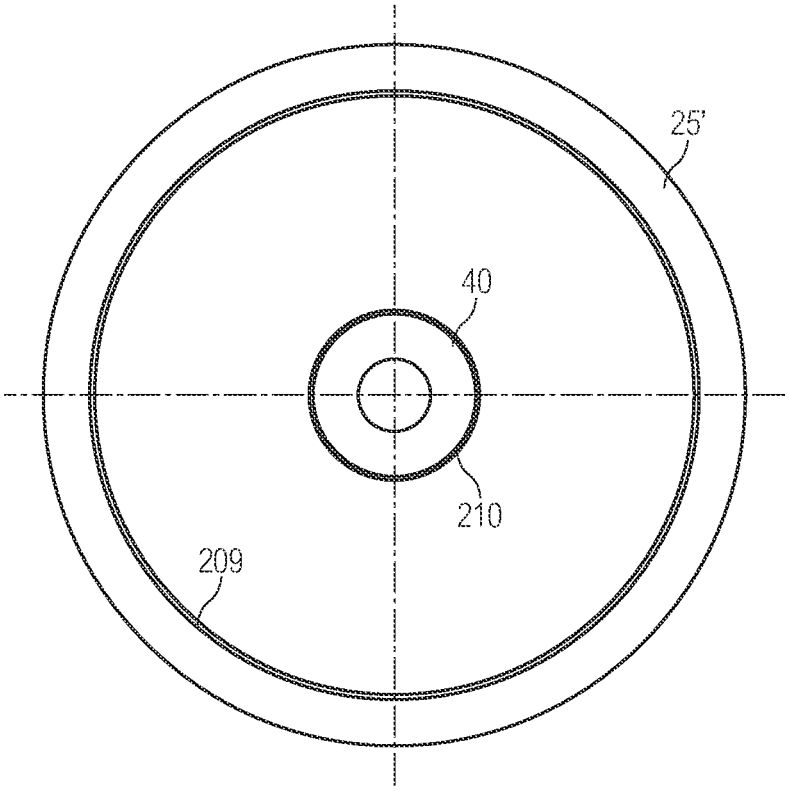
FIG. 11 shows a view of the top part of the magnetic lock from FIGS. 9 and 10 from below.

FIG. 11 shows a view of the top part 25' from below in which the guide collar 40', the radius 210 and the peripheral chamfer 209 are shown from below.

Figure 12:
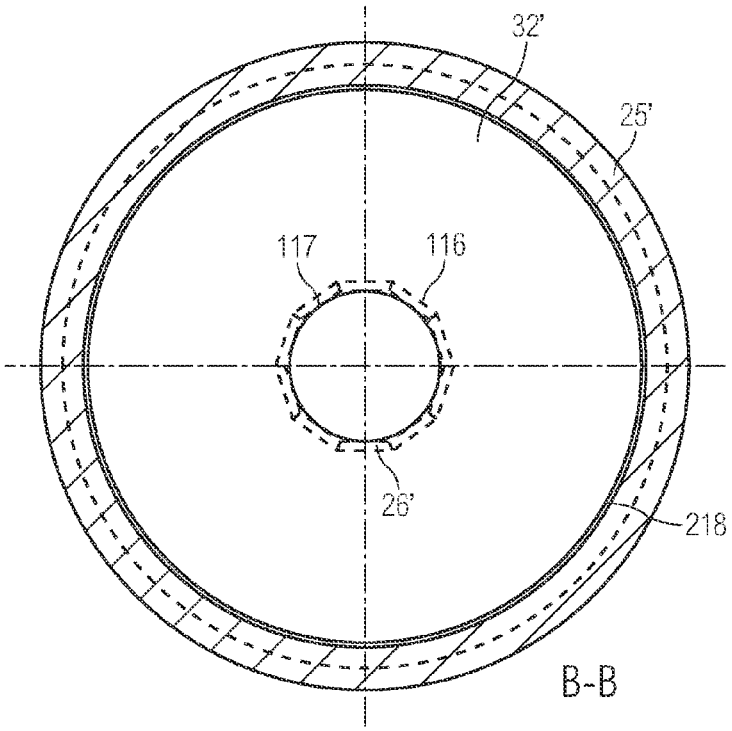
FIG. 12 shows a section of the magnetic lock from FIG. 9.

FIG. 12 shows a view of the bottom part 32' along intersection line B-B in FIGS. 9 and 10 from below. The bottom part 32' has a cylindrical opening 117 in the top section, and an opening 116 in the form of a regular decagon in the bottom section drawn as a dashed line.

Figure 13:
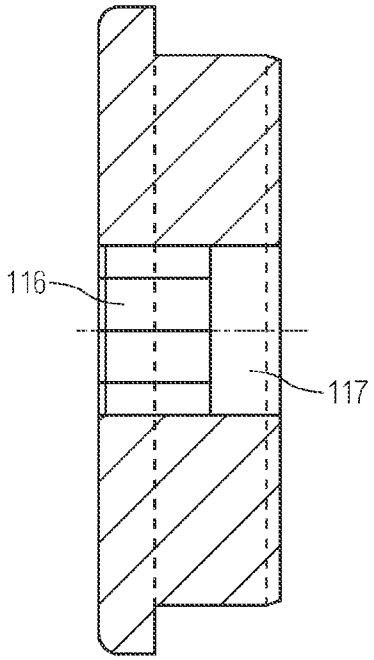
FIG. 13 shows a cross-section of a bottom part of the magnetic lock from FIG. 9.

FIG. 13 shows a cross-section of the bottom part 32' from FIG. 9. The bottom, decagonal opening 116 and the top, round opening 117 are shown from the side.

Figure 14:
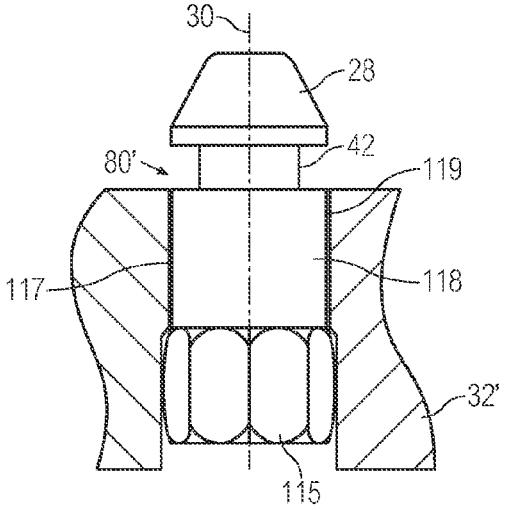
FIG. 14 shows a section of the cross-section from FIG. 9.
Figure 15:
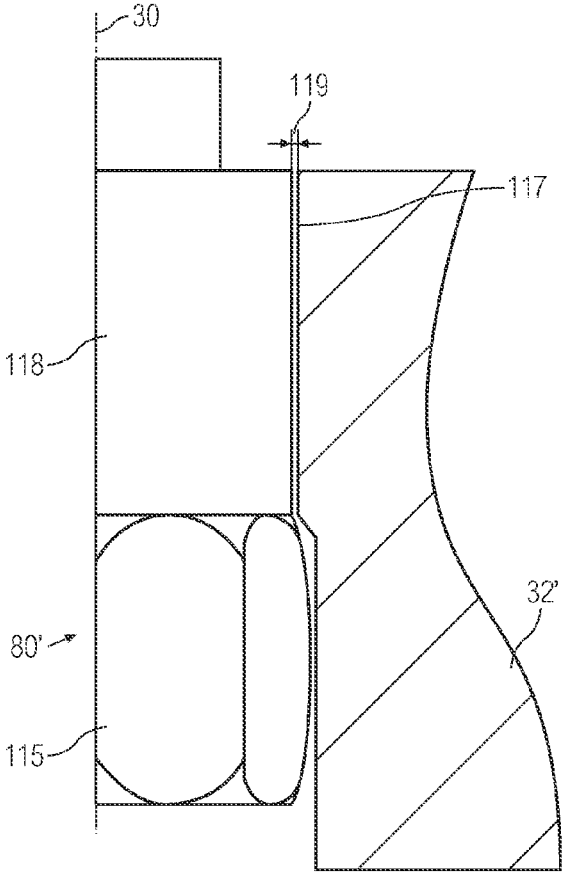
FIG. 15 shows a section of the cross-section from FIG. 14.

FIGS. 14 and 15 show a section of the bottom part 32' from FIG. 13 and a pin shaft 80' inserted therein. As can be seen in FIGS. 14 and 15, the gap 119 between the pin shaft 80' and the round opening 117 of the bottom part 32' is designed to be so narrow that the pin shaft 80' can only tip slightly with reference to the axis 30. This keeps the catches 36, 38 from tipping so that the locking plates 53, 55 cannot tilt in the peripheral pin groove 42. This makes it easier to open the magnetic lock 20 with a magnetic key.

Figure 17:
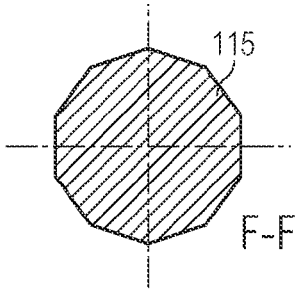
FIG. 17 shows a cross-section of a decagon of the pin from FIG. 16.

FIGS. 16 and 17 show a pin shaft 80' according to the exemplary embodiment in FIGS. 9 to 15. FIG. 16 shows a side view of the pin 22'. The pin shaft 80' has a cylindrical section 118 at its top end. Adjacent thereto, the pin shaft 80' has a decagonal section 117 with a decagonal cross-section. Below the decagonal section, the pin shaft 80' has a cylindrical shape and transitions at its bottom end into the pin foot 82'. FIG. 17 shows a cross-section of the pin 22' from FIG. 16 along cross-sectional line F-F that illustrates the shape of the decagonal section 115.

Figure 18:
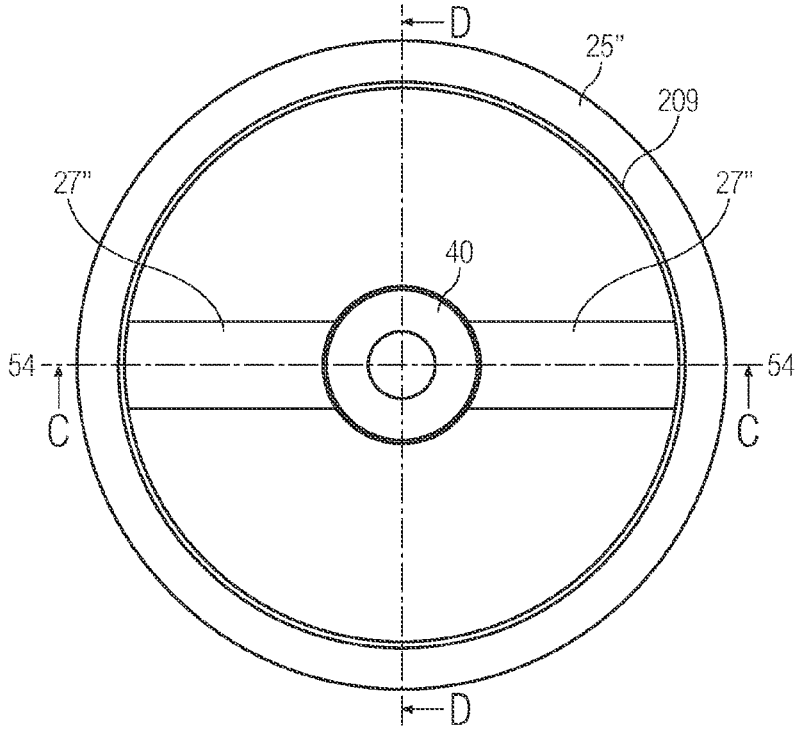
FIG. 18 shows a view of a top part of another embodiment of another magnetic lock from below.
Figure 19:
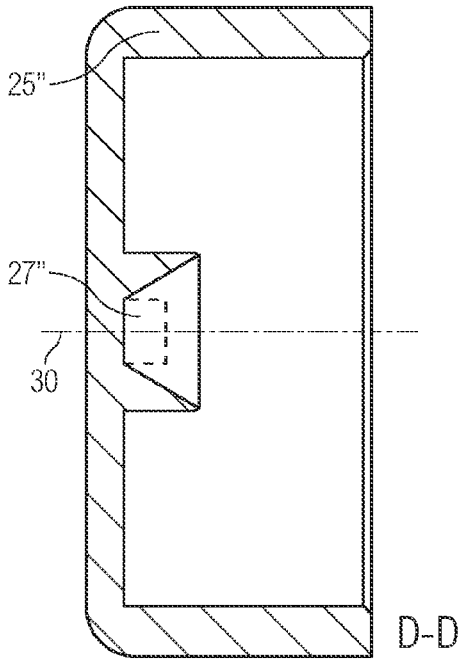
FIG. 19 shows a cross-section of the top part from FIG. 18.
Figure 20:
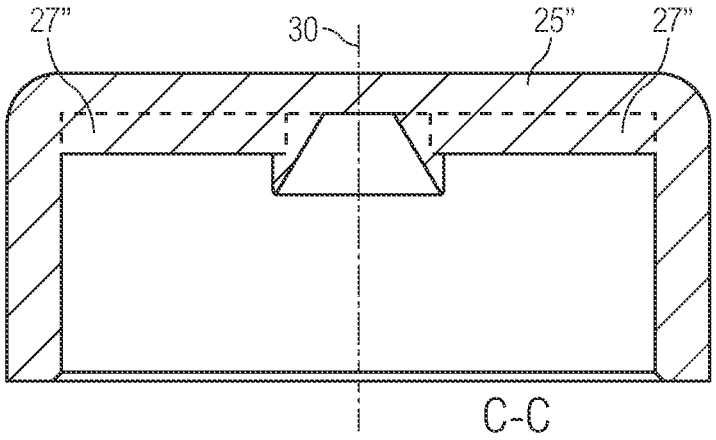
FIG. 20 shows another cross-section of the top part from FIG. 18.

FIGS. 18 to 20 show a top part 25" according to another embodiment. A guide bar a 27" is attached to the bottom side of the top part 25". This guide bar 27" prevents the catches 36, 38 from rotating about the axis 30 of the magnetic lock 20. The guide bar 27" is shown in a plan view in FIG. 18. The guide bar 27" runs along the horizontal axis 54 and is interrupted by the guide collar 40. This can also be seen in the cross-sectional view in FIG. 20 in which the guide bar 27" is shown from the side.

FIG. 19 shows a cross-sectional view of the top part 25" along line D-D. The cross-section of the guide bar 27" is indicated by a dashed line. Within the line of vision, the guide bar 27" lies before and after the cross section C-C in FIG. 18.

Figure 21:
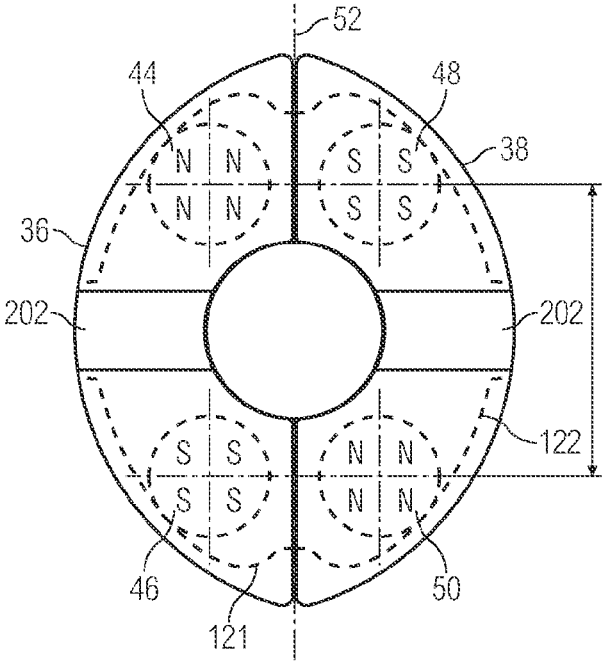
FIG. 21 shows a view of the magnetic catch in a locked state.
Figure 22:
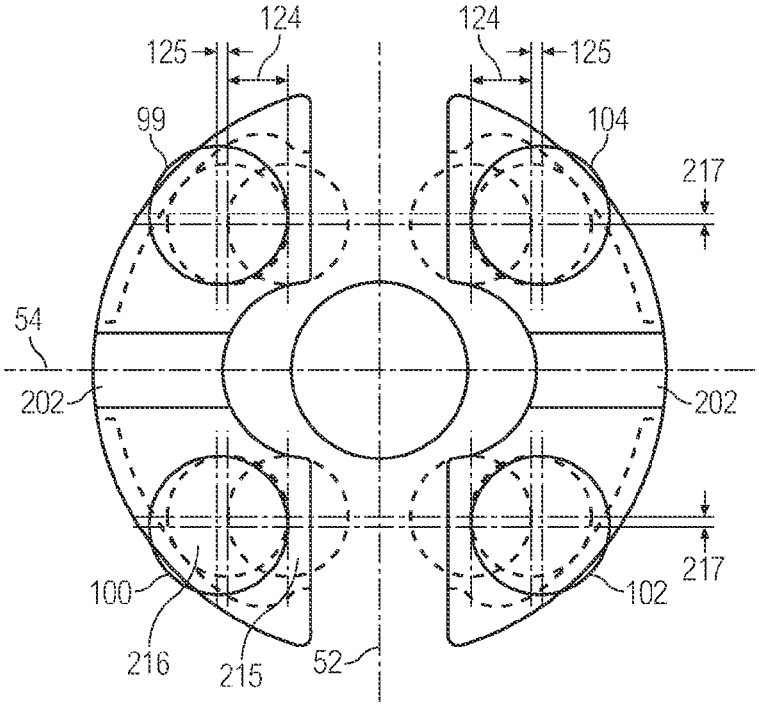
FIG. 22 shows a view of the magnetic catch in an unlocked state.

FIGS. 21 and 22 show plan views of the catches 36, 38 according to the first exemplary embodiment. In FIG. 21, the catches are shown in locked position. FIG. 21 also shows a contour 121 drawn in a dashed line on the catches 36, 38. This contour 121 is also discernible in FIG. 2 described above. The contour 121 is formed by an elevated section 122 that is located on the outside on the top of the catches 36, 38. The elevated section 122 contains a cutout or respecetively notch 202 in which a guide bar 27 can engage.

In FIG. 22, the catches 36, 38 are shown in unlocked position. Dashed lines show the positions of the round magnets 44, 46, 48, 50 of the catches 36, 38 in unlocked position 216, and locked position 215. The position of the key magnets 99, 100, 102, 104 is indicated by a continuous line. The midpoints of the key magnets 99, 100, 102, 104 are further by a horizontal offset 125 from the axis of symmetry 25 than the midpoints of the round magnets 44, 46, 48, 50 of the magnetic lock. In addition, the midpoints of the key magnets 99, 100, 102, 104 are further by a vertical offset 127 from the axis of symmetry 54 than the midpoints of the round magnets 44, 46, 48, 50 of the magnetic lock. The horizontal offset ensures reliable opening since a lateral force still acts on the round magnets 44, 46, 48, 50 even in unlocked position. Due to the vertical offset, a vertical force also acts on the round magnets of the lock parallel to the axis of symmetry 52. This vertical force helps vertically center the magnetic catches 36, 38 and thereby prevents the locking plates 53, 55 from tilting.

Figure 23:
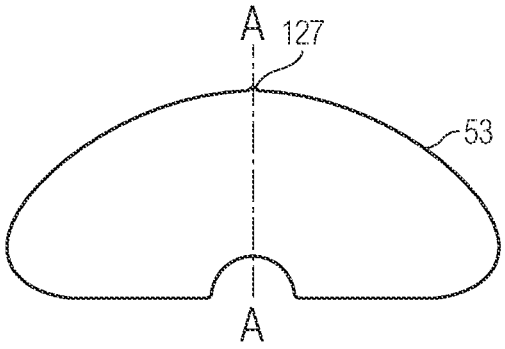
FIG. 23 shows a plan view of a lock plate.
Figure 24:
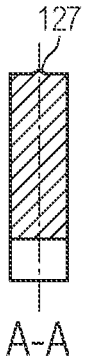
FIG. 24 shows a cross-section of the lock plate from FIG. 23.

FIG. 23 shows one of the two identically constructed lock plates 53, 55 in a plan view. The outline of the lock plate 53, 54 comprises an outer semicircle. In the middle of the outer semicircle, there is a microbar 127. This microbar 127 arises during laser cutting from the beginning and ending of cutting in sheet steel. It can be used to fit the lock plates 53, 55 in the associated catches 36, 38. FIG. 24 shows a cross-sectional view of the lock plate 53 from FIG. 23 along cross-sectional line A-A. The microbar 127 is visible from the side.

Figure 25:
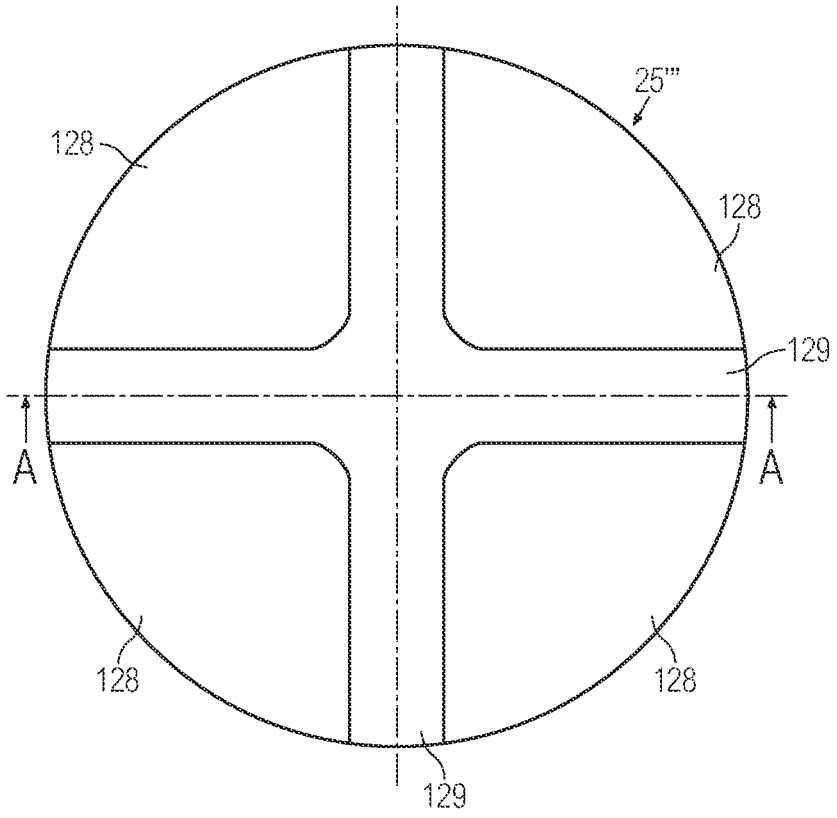
FIG. 25 shows a view of a top housing part of another embodiment of the magnetic lock.
Figure 26:
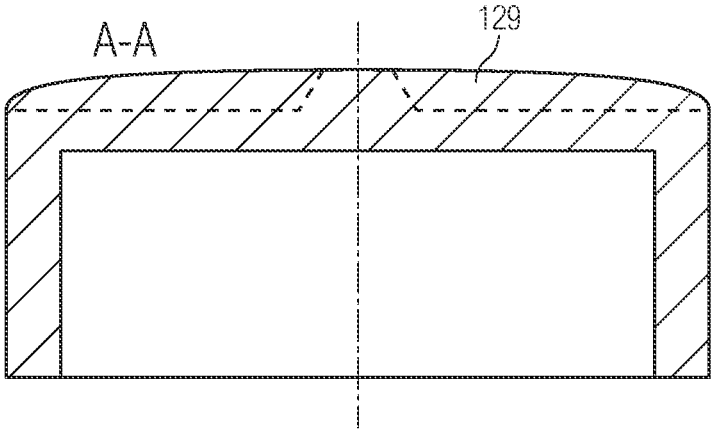
FIG. 26 shows a cross-section of the top housing part from FIG. 25.

FIGS. 25 and 26 show another embodiment of a top part 25''' for a magnetic lock. Four recesses 128 are in the top part 25''' that leave an elevated cross 129. On the bottom side of an associated magnetic key (not shown in this case), there is a cross-shaped bar which fits into the recesses 128 of the top part 25'''. This makes it possible to reliably position the magnetic lock on the top part 25'''. In the embodiment in FIGS. 25 and 26, the catches and magnets of the magnetic lock do not have to be freely rotatable since the correct positioning of the magnets can be ensured by the alignment of the magnetic key.

Figure 27:
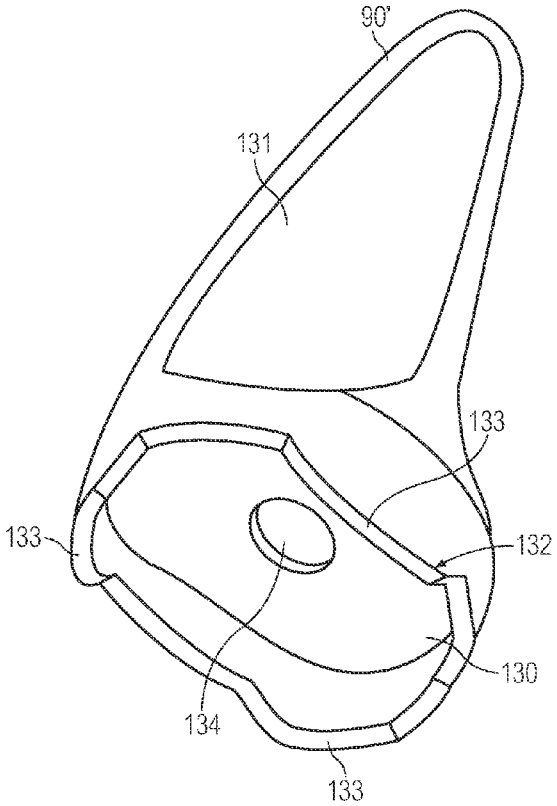
FIG. 27 shows a three-dimensional view of a magnetic lock according to another embodiment.
Figure 28:
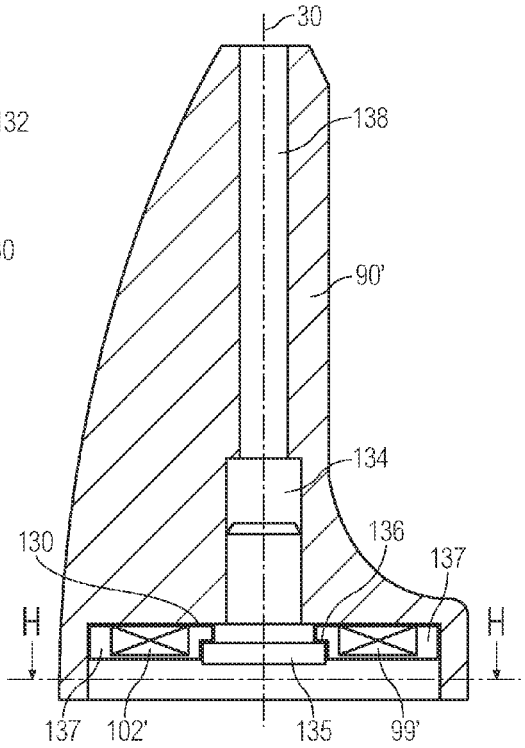
FIG. 28 shows a cross-section of the magnetic lock from FIG. 27.

FIGS. 27 and 28 show another embodiment of a magnetic key 90' for a magnetic lock 20. The magnets 99', 100', 102', 104' of the magnetic key are rotatably arranged on a rotary disk. This can be seen in FIG. 28. Contrastingly, the position of the catches in the magnetic lock is secured against rotation, for example by the guide bar 27 shown in FIGS. 1 to 5 and in FIGS. 16 to 18.

FIG. 27 shows the outer shape of the magnetic key 90'. The magnetic key 90' possesses an elongated, drop-like shape with a flat, circular floor surface 130. Three grip recesses 131 are provided in this drop-like shape that are for grasping the magnetic key with the thumb, index and middle finger. On the floor surface 130 on the bottom side of the magnetic key, there is a circular protrusion 132. The radius of the circular protrusion is dimensioned such that the circular protrusion fits on the top part 25 of the magnetic lock 20. The circular protrusion 132 has symmetrically placed steps 133. The steps 133 make it easier to fit the magnetic key and simultaneously make it easier to visually identify. In the middle of the floor surface 130, there is a hole for receiving an axial bolt 135 which is shown in FIG. 28.

FIG. 28 shows a cross-section of additional details of the magnetic key from FIG. 27. As shown in FIG. 28, the axial bolt 135 has a collar in the form of a step 136. Between the axial bolt 135 and the floor surface 130, there is a rotary disk 137 in the form of an annular catch in which the magnets of the magnetic lock 98', 99', 100', 102' are inserted.

The rotary disk 137 is held against rotating from below by the step 136 of the axial bolt 135. When the rotary disk 137 is fitted on the axial bolt 135, the magnets 99', 100', 102', 104' of the magnetic key can independently align with reference to the magnets of the magnetic lock 20'.

Figure 29:
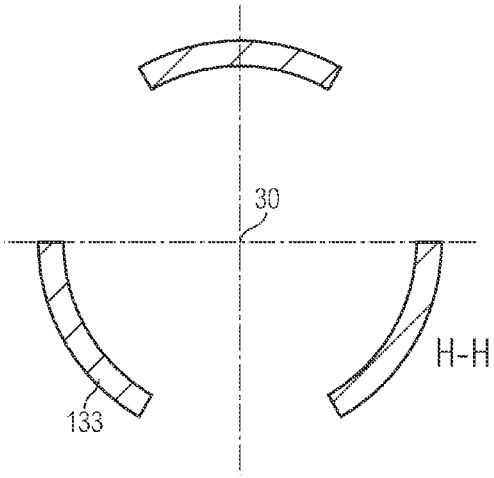
FIG. 29 shows a cross-section of the magnetic lock from FIG. 28.

FIG. 29 shows a cross-section of the magnetic key from FIG. 28 along cross-sectional line H-H. The steps 133 in the protrusion 132 can be seen in a cross-section.

Figure 30:
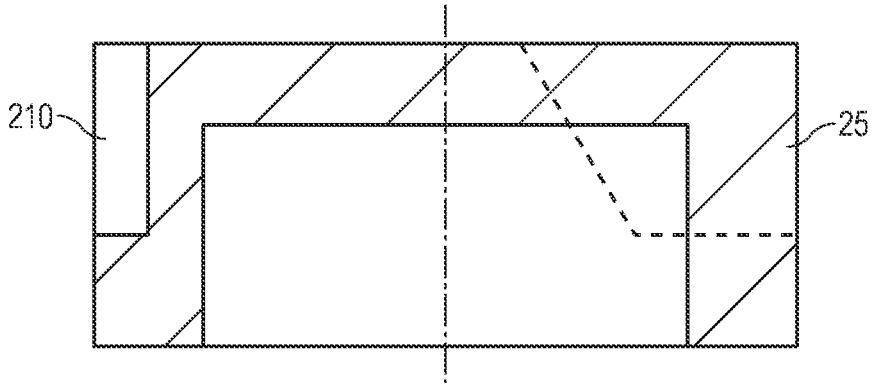
FIG. 30 shows a cross-section of another top part.

FIG. 30 shows a schematic cross-section of a variation of a top part 25 of another magnetic lock. The top part 25 contains cutouts 210 that mate with the steps 133 of the magnetic key from FIG. 27. This ensures that the magnetic key is reliably fit.

Figure 31:
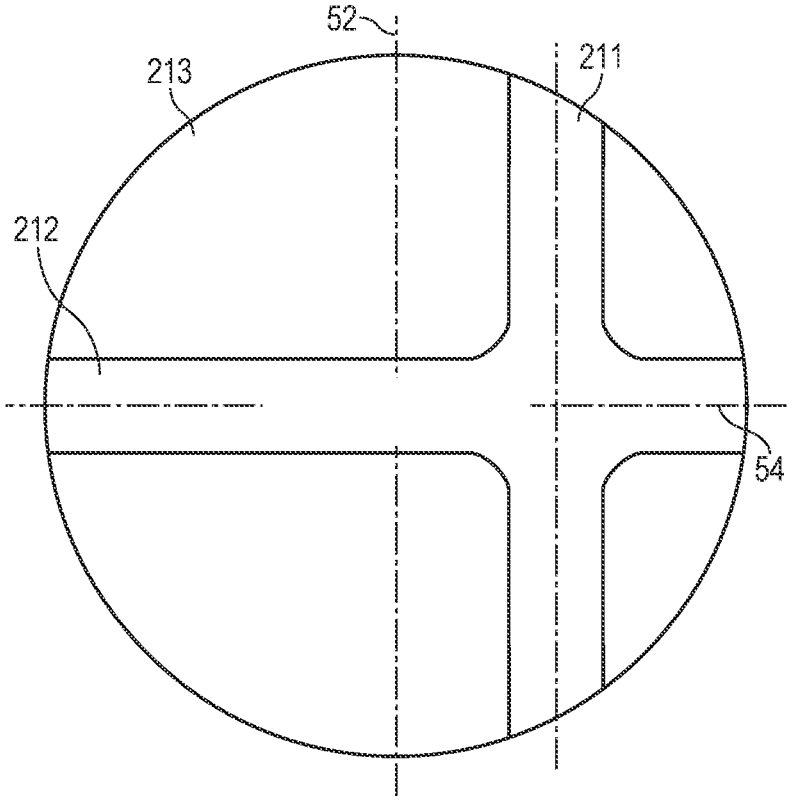
FIG. 31 shows a plan view of lettering on the top part of a magnetic lock

FIG. 31 shows a plan view of an eroded structure 213 for a top part 25 of another magnetic lock. On the top side of the magnetic lock, there are two polished surfaces 211, 212. The polished surface 211 is parallel to and laterally offset from an axis of symmetry 52. The polished surface 212 is symmetrical to an axis of symmetry 54 perpendicular thereto. A trade name is entered in the polished surface 212. The trade name is easily visible from above and protected by the depression 212.

In the following, the functioning of a magnetic key will be explained according to the application for opening a magnetic lock according to the application. There are various alternatives according to the application. According to a first alternative, the lock magnets can be guided by a guide device as shown in FIGS. 1 to 5 and in FIGS. 18 to 20, and the key magnets are fixedly arranged in the lock as shown in FIGS. 6 and 7. According to a second alternative, the magnetic catches 36, 38 can be arranged freely rotatable as shown in FIGS. 9 to 17, and the key magnets can be fixedly arranged in the key. According to a third alternative, the lock magnets can be guided by a guide device, and the key magnets can be arranged on a rotary disk as shown in FIG. 27, 28. That which was explained with reference to FIG. 21, 22 in regard to the offsets 125, 217 of the key magnets in relation to the lock magnets correspondingly applies to all alternatives.

The functioning of a magnetic key according to the first alternative was explained above with reference to FIG. 8. The correct fitting position can be found by feeling the effect of the force, or by aligning with the markings. In addition to these two options or alternative to the markings, a keyed fit between the magnetic key and magnetic lock is also possible as explained with reference to the magnetic lock in FIGS. 27-30. This establishes the correct fitting position.

When fitting a magnetic key according to FIGS. 27-29, The steps 133 of the magnetic key 90' are inserted in the recesses 210 in the top part 25 of the magnetic lock 20. Due to the magnetic attraction between the key magnets 99', 100', 102', 104' and the lock magnets 44, 46, 48, 50, the rotary disk 137 of the magnetic key 90' rotates so that the key magnets 99', 100', 102', 104' align in relation to the lock magnets 44, 46, 48, 50 such that the opposing poles are opposite each other. Furthermore, the lock magnets 44, 46, 48, 50 are pulled by the key magnets 99', 100', 102', 104' into locked position as described with reference to FIG. 8.

When the magnetic key is placed on a magnetic lock according to FIGS. 9 to 17, the lock magnets 44, 46, 48, 50 align the magnetic catches 36, 38 arranged in a freely rotatable manner in relation to the key magnets 99, 100, 102, 104 such that the opposite poles oppose each other. Furthermore, the lock magnets 44, 46, 48, 50 are pulled by the key magnets 99', 100', 102', 104' into locked position as described with reference to FIG. 8. This occurs because the attractive force acting between the lock magnets 44, 46, 48, 50 and the key magnets 99', 100', 102', 104' is slightly greater in the aligned position than the attractive force acting between the lock magnets 44, 46, 48, 50.

If there is no magnetic key or respectively corresponding external magnetic force, the magnetic attraction of the lock magnets 44, 46, 48, 50 combines so that the magnetic catches 36, 38 independently pull themselves into the locked position.

In addition, a spring mechanism (not shown) can be provided such as a spiral compression spring, tension spring, leaf spring, elastomer block or a rubber ring such as in EP1 355 550 that moves the magnetic catches into locked position or respectively keeps them in locked position. The key magnets then have to be dimensioned to overcome the attractive force of the key magnets and the counterforce of the spring mechanism.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

REFERENCE CHARACTERS

20 Magnetic lock
22 Pin
24 Housing
25 Top part
26 Opening
27 Guide bar
28 Pin head
30 Longitudinal axis of the pin
32 Bottom part
33 Projection
34 Conical recess
35 Tip groove
36 Left magnetic catch
38 Right magnetic catch
39 Bandage strap
40 Guide collar
41 Eyelet
42 Peripheral pin groove
43 Flow of force
44 Left, top lock magnet
46 Left, bottom lock magnet
48 Right, top lock magnet
50 Right, bottom lock magnet
52 Vertical axis
53 Left lock plate
54 Horizontal axis
55 Right lock plate
56 Outer edge of the left magnetic catch
58 Top, left straight edge of the right magnetic catch
60 Bottom, left straight edge of the left magnetic catch
62 Left semicircular edge of the magnetic catch
63 Left semicircular edge of the lock plate
64 Outer edge of the right magnetic catch
66 Top, right straight edge of the right magnetic catch
68 Bottom, right straight edge of the right magnetic catch
70 Right semicircular edge of the magnetic catch
71 Right semicircular edge of the lock plate
72 Top marking of the magnetic lock
74 Left marking of the magnetic lock
76 Bottom marking of the magnetic lock
78 Right marking of the magnetic lock
80 Pin shaft
82 Pin foot
84 Magnet
90 Magnetic key
92 Body
94 Contour for engagement
96 Floor surface
98 Edge of the magnetic key
99 Left, top key magnet
100 Left, bottom key magnet
102 Right, bottom key magnet
104 Right, top key magnet
106 Top marking of the magnetic key
108 Left marking of the magnetic key
110 Bottom marking of the magnetic key
112 Right marking of the magnetic key
115 Decagonal section
116 Decagonal opening
117 Circular opening
118 Round section
119 Gap
121 Contour in the catch
122 Elevated contour
124 Minimum distance
125 Safe distance
127 Microbar
128 Recessed area
129 Elevation
130 Floor surface
131 Recessed grip
132 Protrusion
133 Step in the projection

134 Bore
135 Axial bolts
136 Collar
137 Rotary disk
138 Through-hole
150 Contour
200 Gap
201 Plane surface
202 Contour recess
203 Wall
204 Top plane surface
205 Inner wall
206 Cylindrical surface
207 Top plane surface
208 Contour
209 Chamfer
210 Radius
211 Groove-like recess
212 Groove-like recess
213 Top piece
215 Locked position
216 Unlocked position
217 Vertical offset

The invention claimed is:

1. A magnetic lock (20) comprising a first latch (36, 53) and a second latch (38, 55) provided in the magnetic lock (20), the first latch (36, 53) having a first permanent magnet (44), and the second latch (38, 55) having a second permanent magnet (48), wherein the first latch (36, 53) and the second latch (38, 55) can move back and forth between a locked position and an unlocked position so that, when in the locked position, the first latch (36, 53) and the second latch (38, 55) at least partially close a receiving hole (26), the first permanent magnet (44) and the second permanent magnet (48) exerting a force on each other, such that the first latch (36, 54) and the second latch (38, 55) are pulled into the locked position by the first permanent magnet (44) and the second permanent magnet (48).

2. The magnetic lock (20) according to claim 1, wherein the first latch (36, 53) has two first permanent magnets (44, 46) and the second latch (38, 55) has two second permanent magnets (48, 50).

3. The magnetic lock (20) according to claim 1, wherein the latches (36, 53; 38, 55) are secured by a lock contour (27) and a latch contour (121) against rotating relative to the magnetic lock (20).

4. The magnetic lock (20) according to claim 1, wherein a recess (34) is provided in a top part (25), and a tip groove (35) is provided in a bottom part (32), the latches (36, 53; 38, 55) being accommodated in the tip groove (35) when the latches (36, 53; 38, 55) are accommodated in the recess (34).

5. The magnetic lock (20) according to claim 1, wherein the first latch (36, 53) and/or the second latch (38, 55) has a catch (36; 38) that is produced from a nonmagnetic material.

6. The magnetic lock (20) according to claim 1, wherein the first latch (36, 53) and/or the second latch (38, 55) has a lock plate (53; 55) that comprises metal.

7. A lock arrangement with a magnetic lock (20) according to claim 1 and with a locking element (22) for the receiving hole (26), having the following features:

a pin head (28), a peripheral pin groove (42) below the pin head (28), a pin shaft (80) below the peripheral pin groove (42), wherein the first latch (36, 53) and the second latch (38, 55) engage in the peripheral pin groove (42) when in the locked position.

8. A magnetic key (90) having at least two key magnets (99, 104) arranged next to each other such that a north pole of one key magnet (99) points in one direction, and a north pole of the other key magnet (104) points substantially in the opposite direction, wherein the key magnets (99, 100, 102, 104) are arranged on a rotary disc (137) which is rotatable with reference to the magnetic key (90).

9. The magnetic key (90) according to claim 8, wherein a total of four key magnets (99, 100, 102, 104) are provided that are arranged such that the same pole points upwards when the key magnets oppose each other.

10. The magnetic key (90) of claim 8, wherein projections (133) are provided on a protrusion (132) on the bottom side of the magnetic key that engage in recesses (210) which are provided in the top side of a magnetic lock (20).

11. A combination of a magnetic key (90) according to claim 8 and a magnetic lock (20) wherein each key magnet (99; 100; 102; 104) in the unlocked position has a horizontal offset (125) relative to a neighboring lock magnet (44; 46; 48; 50) such that the key magnets (99; 100; 102; 104) are spaced farther apart than the lock magnets (44; 46; 48; 50).

12. A combination of a magnetic key (90) according to claim 8 and a magnetic lock (20), wherein each key magnet (99; 100; 102; 104) in unlocked position has a vertical offset (217) relative to a neighboring lock magnet (44; 46; 48; 50).

13. A magnetic lock (20) comprising a first latch (36, 53) and a second latch (38, 55) provided in the magnetic lock (20), the first latch (36, 53) having a first permanent magnet (44), and the second latch (38, 55) having a second permanent magnet (48), wherein the first latch (36, 53) and the second latch (38, 55) can move back and forth between a locked position and an unlocked position so that, when in the locked position, the first latch (36, 53) and the second latch (38, 55) at least partially close a receiving hole (26), the first permanent magnet (44) and the second permanent magnet (48) exerting a force on each other, such that the first latch (36, 54) and the second latch (38, 55) are pulled into the locked position by the first permanent magnet (44) and the second permanent magnet (48), and further wherein the first latch (36, 53) has two first permanent magnets (44, 46) and the second latch (38, 55) has two second permanent magnets (48, 50).

* * * * *